US010385813B2

(12) United States Patent
Matsukawa et al.

(10) Patent No.: US 10,385,813 B2
(45) Date of Patent: Aug. 20, 2019

(54) FUEL INJECTION VALVE

(71) Applicant: DENSO CORPORATION, Kariya, Aichi-pref. (JP)

(72) Inventors: Tomoji Matsukawa, Kariya (JP); Eiji Itoh, Kariya (JP); Shinsuke Yamamoto, Kariya (JP); Kouichi Mochizuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 257 days.

(21) Appl. No.: 15/500,977

(22) PCT Filed: Jul. 17, 2015

(86) PCT No.: PCT/JP2015/003612
§ 371 (c)(1),
(2) Date: Feb. 1, 2017

(87) PCT Pub. No.: WO2016/031125
PCT Pub. Date: Mar. 3, 2016

(65) Prior Publication Data

US 2017/0218907 A1 Aug. 3, 2017

(30) Foreign Application Priority Data

Aug. 26, 2014 (JP) ..... 2014-171728
Apr. 8, 2015 (JP) ..... 2015-079149

(51) Int. Cl.
*F02M 61/16* (2006.01)
*F02M 51/06* (2006.01)
*F02M 63/00* (2006.01)

(52) U.S. Cl.
CPC ..... *F02M 61/166* (2013.01); *F02M 51/0671* (2013.01); *F02M 51/0682* (2013.01);
(Continued)

(58) Field of Classification Search
CPC ..... F03M 61/166; F02M 61/166; F02M 51/0671; F02M 51/0682; F02M 51/0685; F02M 63/0075
(Continued)

(56) References Cited

U.S. PATENT DOCUMENTS

2012/0080542 A1 4/2012 Imai
2013/0075501 A1 3/2013 Miyake et al.
2016/0097358 A1 4/2016 Miyake et al.

FOREIGN PATENT DOCUMENTS

JP 2002-89449 3/2002
JP 2013-100756 5/2013
JP 2013-104340 5/2013

*Primary Examiner* — Steven J Ganey
(74) *Attorney, Agent, or Firm* — Nixon & Vanderhye P.C.

(57) ABSTRACT

A fuel injection valve includes: a circular plate portion that is abuttable against an end surface of a needle opposite from a valve seat while the needle being provided to open and close an injection hole upon lifting and seating of the needle relative to the valve seat; and a tubular portion that extends from the circular plate portion toward the valve seat and has an end part, which is opposite from the circular plate portion and is abuttable against a movable core second contact surface of a movable core opposite from the valve seat. In a state where the circular plate portion abuts against the needle, and the tubular portion abuts against the movable core, a gap is formed between a flange member end surface of a flange of the needle and a movable core first contact surface of the movable core opposite from the valve seat.

43 Claims, 26 Drawing Sheets

(52) U.S. Cl.
CPC .... *F02M 51/0685* (2013.01); *F02M 63/0075* (2013.01); *F02M 2200/50* (2013.01)

(58) Field of Classification Search
USPC ..... 239/585.1–585.5
See application file for complete search history.

FUEL INJECTION VALVE

CROSS REFERENCE TO RELATED APPLICATION

This application is the U.S. national phase of International Application No. PCT/JP2015/003612 filed on Jul. 17, 2015 and is based on and incorporates herein by reference Japanese Patent Application No. 2014-171728 filed on Aug. 26, 2014 and Japanese Patent Application No. 2015-79149 filed on Apr. 8, 2015.

TECHNICAL FIELD

The present disclosure relates to a fuel injection valve that injects fuel into an internal combustion engine (hereinafter referred to as an engine).

BACKGROUND ART

There is known a fuel injection valve that injects fuel, which is received in an inside of a housing, to an outside of the housing by opening and closing of an injection hole of the housing through reciprocation of a needle. For example, the patent literature 1 discloses a fuel injection valve that includes: a coil that generates a magnetic field when an electric power is supplied to the coil; a stationary core that is placed in the magnetic field; a movable core that is placed on a side of the stationary core where an injection hole is placed; a needle that is formed separately from the movable core; and a spring that urges the movable core and the needle in a valve closing direction, wherein a gap is formed between the movable core and the needle at a valve closing time.

In the fuel injection valve of the patent literature 1, when the movable core is magnetically attracted to the stationary core upon generation of the magnetic field by the coil, the movable core is moved in a valve opening direction while being accelerated in the gap formed between the movable core and the needle and then abuts against the needle. In this way, in the fuel injection valve of the patent literature 1, a relatively large valve opening force is applied to the needle. In the fuel injection valve of the patent literature 1, a recess, which receives a contact portion of the needle that abuts against the movable core, is formed in the movable core. A wear resistant film is formed in the recess to withstand a shock generated upon abutment of the recess against the needle. However, since the shape of the recess is complicated, it is difficult to form the wear resistant film in an appropriate manner. Therefore, there is a possibility of that the movable core is worn through the abutment of the movable core against the needle, so that an injection characteristic of the fuel injection valve may be disadvantageously changed within a relatively short period of time. Furthermore, in order to form the wear resistant film that has an appropriate film thickness, the number of steps for forming the film is increased to cause an increase in the manufacturing costs of the fuel injection valve.

CITATION LIST

Patent Literature

Patent Literature 1: JP2012-097728A (corresponding to US2012/0080542A1)

SUMMARY OF INVENTION

It is an objective of the present disclosure to provide a fuel injection valve that increases a force applied to a needle in a valve opening direction while reducing a secular change of a fuel injection characteristic of the fuel injection valve.

The present disclosure provides a fuel injection valve that includes a housing, a needle member, a flange member, a stationary core, a movable core, a coil, a contact member, a leg member, and a first urging member.

The flange member radially outwardly projects from a section of another end part of the needle member.

The movable core is movable relative to the needle member on a side of the flange member where the valve seat is placed. The movable core includes a movable core contact surface that is abuttable against a flange member end surface of the flange member located on the side where the valve seat is placed.

The contact member is abuttable against at least one of: an end surface of the needle member located on a side, which is opposite from the valve seat; and an end surface of the flange member located on the side, which is opposite from the valve seat.

The leg member has one end part, which is formed integrally with the contact member or is abuttable against the contact member, and another end part, which extends away from the contact member toward the valve seat and is abuttable against an end surface of the movable core, which is opposite from the valve seat.

The first urging member has one end part, which abuts against the contact member and is capable of urging the needle member toward the valve seat.

The fuel injection valve of the present disclosure is characterized in that in the state where the another end part of the leg member abuts against the movable core, and the contact member abuts against the flange member or the needle member, the gap can be formed between the flange member end surface and the movable core contact surface.

In the fuel injection valve of the present disclosure, in the state where the leg member abuts against the movable core, and the contact member abuts against the flange member or the needle member, the gap is formed between the flange member end surface and the movable core contact surface. At the valve opening time, when the movable core is magnetically attracted to the stationary core side upon supply of the electric power to the coil, the movable core is moved in the valve opening direction while being accelerated through the gap and abuts against the flange member. In this way, a relatively large force can be applied to the needle in the valve opening direction.

Furthermore, the fuel injection valve of the present disclosure includes the contact member that is abuttable against at least one of: the end surface of the needle member located on the side, which is opposite from the valve seat; and the end surface of the flange member located on the side, which is opposite from the valve seat. The fuel injection valve of the present disclosure also includes the leg member that has the another end part, which extends from the contact member toward the valve seat and is abuttable against the end surface of the movable core that is opposite from the valve seat. The flange member is reciprocatable between the contact member and the movable core, which are arranged such that a predetermined gap is maintained between the contact member and the movable core by the leg member. In this way, it is possible to have the gap, which is defined by the flange member end surface and the movable core contact surface and is used for accelerating the movable core at the valve opening time, without forming the space, which receives the flange member, in the movable core. Thus, the shape of the movable core can be simplified. Therefore, the wear resistant film can be formed at the appropriate film thickness in the portion of the movable core, which abuts against the flange at the time of the valve opening. Thereby, it is possible to limit the wearing of the movable core.

As discussed above, the fuel injection valve of the present disclosure can increase the force exerted against the needle in the valve opening direction while the secular change of the injection characteristic, which would be caused by the wearing of the movable core, is minimized.

DESCRIPTION OF EMBODIMENTS

Figure 1:
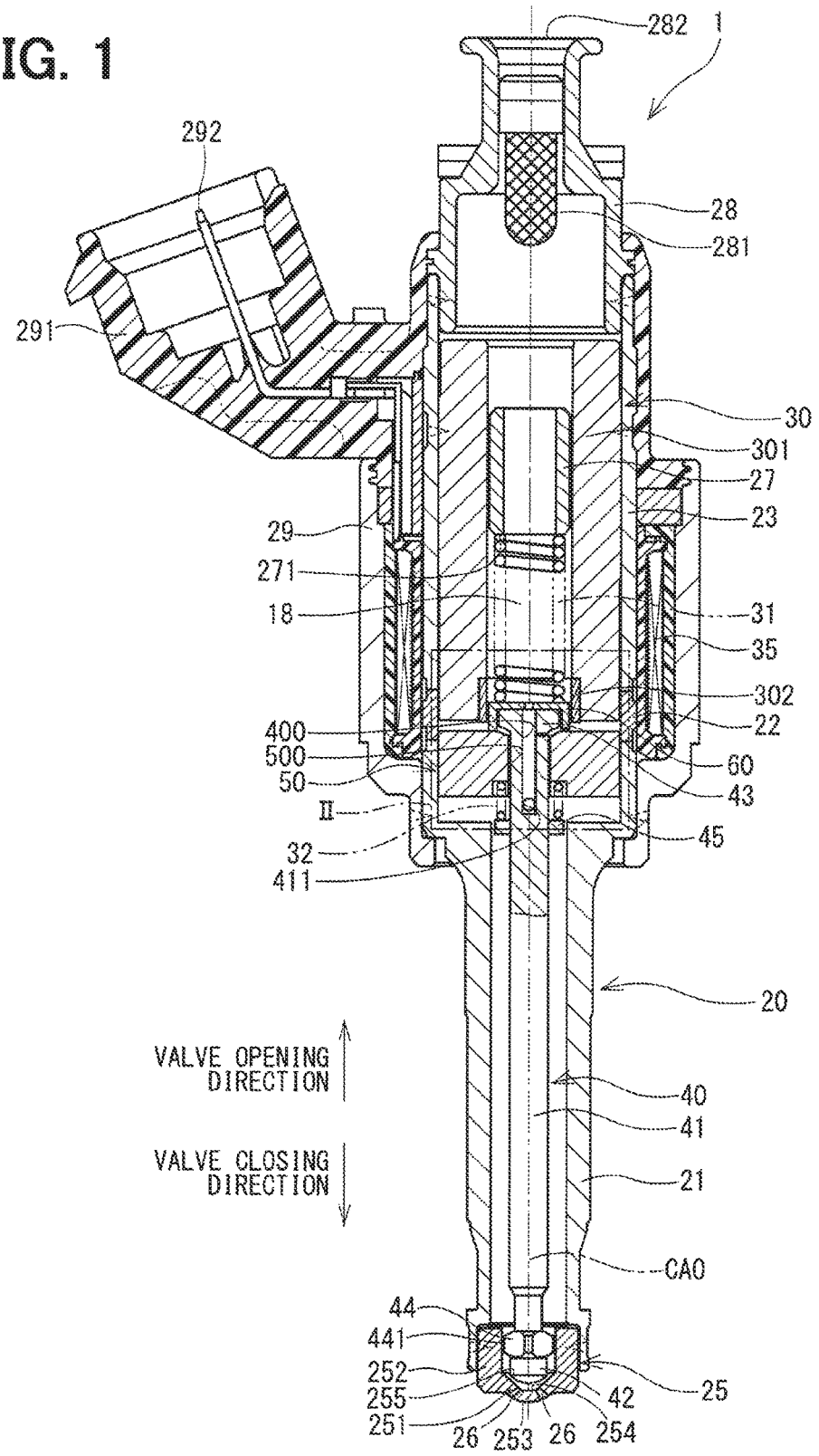
FIG. 1 is a cross sectional view of a fuel injection valve according to a first embodiment of the present disclosure.

Hereinafter, embodiments of the present disclosure will be described with reference to the drawings.

(First Embodiment)

A fuel injection valve 1 according to a first embodiment of the present disclosure will be described with reference to FIGS. 1 to 5. FIGS. 1, 2, 4 and 5 indicate a valve opening direction, which is a lifting direction of a needle 40 away from a valve seat 255, and a valve closing direction, which is a seating direction of the needle 40 against the valve seat 255.

The fuel injection valve 1 is used in a fuel injection apparatus of, for example, a direct injection type gasoline engine (not shown) and injects gasoline, which serves as fuel, into the engine under a high pressure. The fuel injection valve 1 includes a housing 20, a needle 40, a movable core 50, a stationary core 30, a flange receiving member 60, a coil 35, a first spring (serving as a first urging member) 31, and a second spring (serving as a second urging member) 32.

As shown in FIG. 1, the housing 20 includes a first tubular member 21, a second tubular member 22, a third tubular member 23 and an injection nozzle 25, The first tubular member 21, the second tubular member 22 and the third tubular member 23 are respectively shaped into a cylindrical tubular form. The first tubular member 21, the second tubular member 22 and the third tubular member 23 are coaxially arranged in this order and are joined together.

The first tubular member 21 and the third tubular member 23 are made of a magnetic material, such as ferritic stainless steel, and are magnetically stabilized through a magnetic stabilization process. The first tubular member 21 and the third tubular member 23 have a relatively low hardness. The second tubular member 22 is made of a non-magnetic material, such as austenitic stainless steel. A hardness of the second tubular member 22 is higher than the hardness of the first tubular member 21 and the hardness of the third tubular member 23.

The injection nozzle 25 is installed to an opposite end part of the first tubular member 21, which is opposite from the second tubular member 22. The injection nozzle 25 is made of metal, such as martensitic stainless steel, and is shaped into a tubular form having a bottom. The injection nozzle 25 is welded to the first tubular member 21. The injection nozzle 25 is quenched in a quenching process to have a predetermined hardness. The injection nozzle 25 includes an injecting portion 251 and a tubular portion 252.

The injecting portion 251 is symmetric with respect to a central axis CAO of the housing 20, which serves as a line of symmetry and is coaxial with a central axis of the fuel injection valve 1. An outer wall 253 of the injecting portion 251 projects from an inside of the injection nozzle 25 in a direction of the central axis CAO. A plurality of injection holes 26, each of which communicates between an inside and an outside of the housing 20, are formed in the injecting portion 251. A valve seat 255 is formed at an outer periphery of inside openings of the injection holes, which are formed in an inside wall 254 of the injecting portion 251.

The tubular portion 252 surrounds a radially outer side of the injecting portion 251 and extends in an opposite direction that is opposite from a projecting direction of the outer wall 253 of the injecting portion 251. One end part of the tubular portion 252 is connected to the injecting portion 251, and the other end part of the tubular portion 252 is connected to the first tubular member 21.

The needle 40 is made of metal, such as martensitic stainless steel. The needle 40 is quenched in a quenching process to have a hardness that is generally the same as the hardness of the injection nozzle 25.

The needle 40 is reciprocatably received in the inside of the housing 20. The needle 40 includes a shaft portion 41, a seal portion (serving as one end part of the needle member) 42, and a flange (serving as a flange member) 43. The shaft portion 41, the seal portion 42 and the flange 43 are formed integrally as a one-piece body. The shaft portion 41 and the seal portion 42 correspond to a needle member of the present disclosure.

The shaft portion 41 is a rod portion that has an end part, which is located on the stationary core 30 side and is shaped into a tubular form. A flow passage 400, which conducts fuel directed toward the injection nozzle 25, is formed in the inside of the end part of the shaft portion 41, which is located on the stationary core 30 side. The flow passage 400 is communicated with a hole 411 of the shaft portion 41 at the valve seat 255 side of the flow passage 400. That is, the hole 411 communicates between the flow passage 400 and an outside of the shaft portion 41.

The seal portion 42 is formed at an end part of the shaft portion 41, which is located on the valve seat 255 side, in such a manner that the seal portion 42 is abuttable against the valve seat 255. When the seal portion 42 is lifted away from or seated against the valve seat 255, the needle 40 opens or closes the injection holes 26 to enable or disable communication between the inside and the outside of the housing 20.

A slidable portion 44 is formed between the shaft portion 41 and the seal portion 42. The slidable portion 44 is shaped into a cylindrical tubular form, and parts of an outer wall 441 of the slidable portion 44 are chamfered. Other parts of the outer wall 441, which are not chamfered, are slidable relative to an inner wall of the injection nozzle 25. Thereby, reciprocation of the needle 40 is guided through a distal end part of the needle 40, which is located at the valve seat 255 side.

The flange 43 is shaped into a generally circular ring form and radially outwardly projects from the end part of the shaft portion 41, which is located on the stationary core 30 side and serves as the other end part of the needle member. The flange 43 is shaped such that an outer diameter of the flange 43 is larger than an outer diameter of the shaft portion 41. A flange member end surface 431 of the flange 43, which is located on the valve seat 255 side, is tilted relative to the central axis CAO. Specifically, the flange member end surface 431 is formed such that as a distance from the central axis CAO is increased toward the radially outer side along the flange member end surface 431, the flange member end surface 431 is progressively spaced away from the valve seat 255 in the axial direction.

The movable core 50 is made of a magnetic material, such as ferritic stainless steel, and is shaped into a tubular form. The movable core 50 is movable toward the valve seat 255 side of the flange 43 relative to the needle 40.

Figure 2:
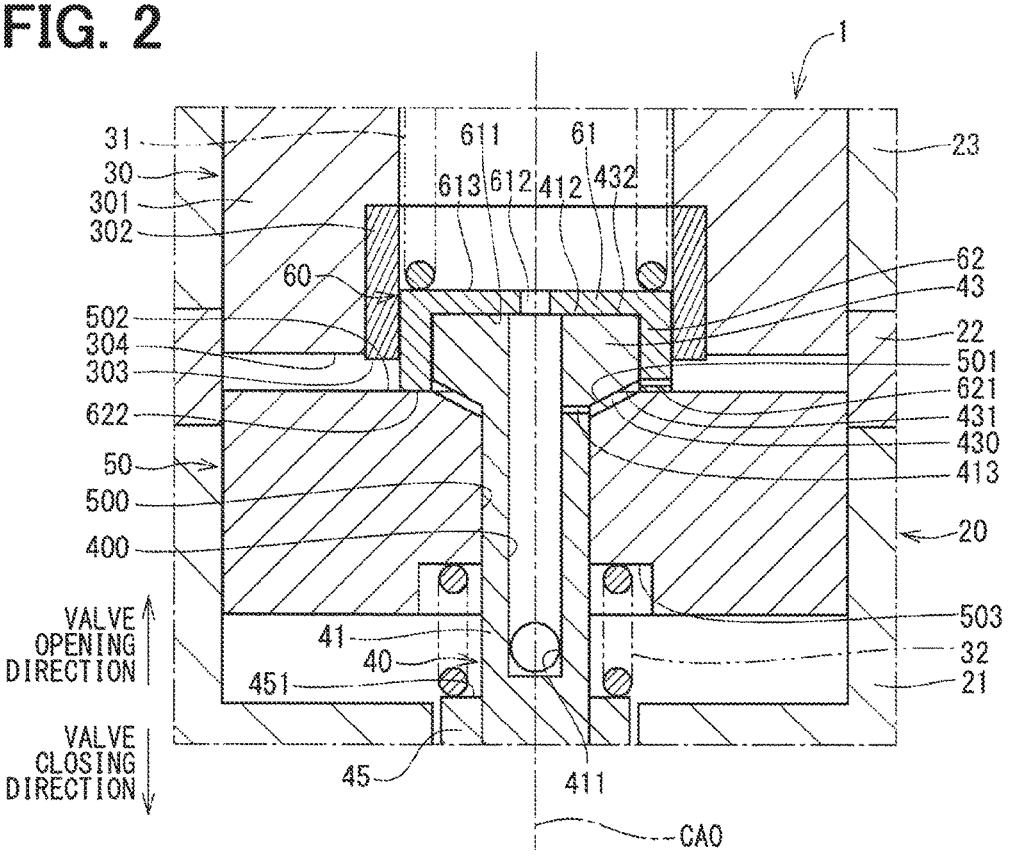
FIG. 2 is a partial enlarged view of a portion II of FIG. 1.

The movable core 50 has a movable core through hole 500, through which the shaft portion 41 is inserted. A movable core first contact surface (serving as a movable core contact surface) 501, which is opposed to the flange member end surface 431, is formed in an outer periphery of an opening of the movable core through hole 500, which is located on the stationary core 30 side. A wear resistant film, such as a hard chrome plating film, is formed on the movable core first contact surface 501. The movable core first contact surface 501 has a tilt angle, which is the same as the tilt angle of the flange member end surface 431, relative to the central axis CAO. As shown in FIG. 2, in a state where a circular plate portion 61 of a flange receiving member 60 described later abuts against the shaft portion 41 and the flange 43, and a tubular portion 62 of the flange receiving member 60 abuts against the movable core 50, a gap 430 is formed between the flange member end surface 431 and the movable core first contact surface 501. The gap 430 is communicatable with a flow passage 400 through a needle communication passage 413 formed in the shaft portion 41.

A movable core second contact surface 502, which serves as an annular end surface of the movable core that is opposite from the valve seat, is formed on a radially outer side of the movable core first contact surface 501. The movable core second contact surface 502 is formed to extend in a direction that is generally perpendicular to the central axis CAO. Similar to the movable core first contact surface 501, a wear resistant film is formed on the movable core second contact surface 502. The movable core second contact surface 502 is abuttable against an end surface of the stationary core 30, which is located on the valve seat 255 side.

The stationary core 30 is joined to the third tubular member 23 of the housing 20 by welding, so that the stationary core 30 is fixed in the inside of the housing 20. The stationary core 30 includes a stationary core main body 301 and a stationary core slidable portion 302.

The stationary core main body 301 is made of a magnetic material, such as ferritic stainless steel. The stationary core main body 301 is magnetically stabilized through a magnetic stabilization process and is placed in a magnetic field that is formed by the coil 35 described later.

The stationary core slidable portion 302 is a tubular member that is placed in an inside of an end part of the stationary core main body 301, which is located on the valve seat 255 side. For instance, chrome plating is applied to a surface of the stationary core slidable portion 302, so that the stationary core slidable portion 302 has a hardness that is generally equal to the hardness of the flange receiving member 604, the flange 43 or the movable core 50. As shown in FIG. 2, an end surface 303 of the stationary core slidable portion 302, which is located on the valve seat 255 side, is located on the valve seat 255 side of an end surface 304 of the stationary core main body 301, which is located on the valve seat 255 side. Thereby, when the movable core 50 is moved in the valve opening direction, the movable core second contact surface 502 of the movable core 50 abuts against the end surface 303 of the stationary core slidable portion 302, so that the movement of the movable core 50 in the valve opening direction is limited.

Figure 3:
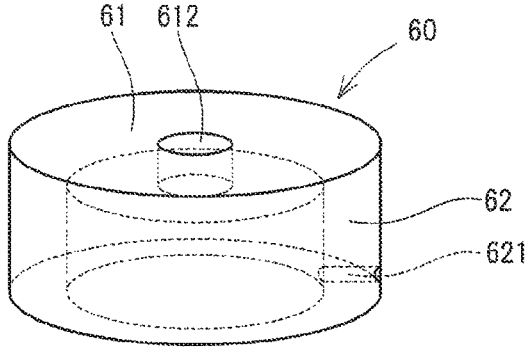
FIG. 3 is a perspective view of a flange receiving member of the fuel injection valve according to the first embodiment of the present disclosure.

The flange receiving member 60 is reciprocatably placed on the opposite side of the movable core 50, which is opposite from the valve seat 255, in such a manner that the flange receiving member 60 is received in the inside of the stationary core slidable portion 302 such that the flange receiving member 60 is reciprocatable relative to the stationary core 30. As shown in FIG. 3, the flange receiving member 60 includes the circular plate portion (serving as a contact member) 61 and the tubular portion (serving as a leg member) 62. In the first embodiment, the circular plate portion 61 and the tubular portion 62 are formed integrally as a one-piece body.

The circular plate portion 61 is located on an opposite side of the flange 43, which is opposite from the valve seat 255. The circular plate portion 61 includes an end surface 611 that is abuttable against an end surface (serving as an opposite end surface of the needle member, which is opposite from the valve seat) 412 of the shaft portion 41, which is opposite from the valve seat 255, and an end surface (serving as an end surface of the flange member, which is opposite from the valve seat) 432 of the flange 43, which is opposite from the valve seat 255. In the first embodiment, the end surface 412 and the end surface 432 are located in the same plane, and the end surface 611 is simultaneously abuttable against both of the end surfaces 412, 432.

The circular plate portion 61 includes a communication passage (serving as a contact member communication passage) 612, which extends through the circular plate portion 61 in a direction of the central axis CAO. The communication passage 612 communicates between an outside of the flange receiving member 60 and the flow passage 400. As shown in FIG. 2, a cross sectional area of the communication passage 612 is smaller than a cross sectional area of the flow passage 400.

The tubular portion 62 is a tubular portion that extends from a radially outer side of the circular plate portion 61 toward the valve seat 255. An inner wall of the tubular portion 62 is slidable relative to a radially outer side outer wall of the flange 43. Furthermore, an outer wall of the tubular portion 62 is slidable relative to an inner wall of the stationary core slidable portion 302. One end part of the tubular portion 62 is fixed to the circular plate portion 61. Another end part of the tubular portion 62, which is opposite from the one end part of the tubular portion 62 that is fixed to the circular plate portion 61, is abuttable against the movable core 50. Specifically, an end surface 622 of the tubular portion 62 is abuttable against the movable core second contact surface 502. The tubular portion 62 has a length that enables reciprocation of the flange 43 in an inside of the flange receiving member 60. The tubular portion 62 includes a communication passage (serving as a leg member communication passage) 621, which communicates between an inside and an outside of the tubular portion 62. The communication passage 621 is communicatable with the gap 430, which is formed in an inside of the tubular portion 62.

The coil 35 is shaped into a tubular form and mainly surrounds a radially outer side of the second tubular member 22 and the third tubular member 23. When an electric power is supplied to the coil 35, the magnetic field is generated around the coil 35. When the magnetic field is generated, the stationary core 30, the movable core 50, the first tubular member 21, the third tubular member 23 and the holder 29 form a magnetic circuit, so that the movable core 50 is magnetically attracted to the stationary core 30.

One end part of the first spring 31 contacts an end surface 613 of the circular plate portion 61, which is opposite from the valve seat 255. An adjusting pipe 27 is securely press fitted into an inside of the stationary core 30, and the other end part of the first spring 31 contacts an end surface 271 of the adjusting pipe 27, which is located on the valve seat 255 side. The first spring 31 urges the needle 40 toward the valve seat 255 side, i.e., in the valve closing direction.

A spring seat 45 is installed on a radially outer side of the shaft portion 41, and one end part of the second spring 32 contacts an opposite end surface 451 of the spring seat 45, which is opposite from the valve seat 255. The other end part of the second spring 32 contacts a movable core third contact surface 503 of the movable core 50, which is located on the valve seat 255 side. The second spring 32 urges the movable core 50 toward the stationary core 30 such that the flange member end surface 431 contacts the movable core first contact surface 501.

In the present embodiment, an urging force of the second spring 32 is set to be smaller than an urging force of the first spring 31. Thereby, when the electric power is not supplied to the coil 35, the seal portion 42 of the needle 40 is placed into a contact state where the seal portion 42 contacts the valve seat 255, i.e., is placed into a valve closing state.

A fuel inlet pipe 28, which is shaped into a tubular form, is press fitted into and is welded to an opposite end part of the third tubular member 23, which is opposite from the second tubular member 22. A filter 281 is placed in an inside of the fuel inlet pipe 28. The filter 281 captures foreign objects contained in the fuel that is supplied from an inlet 282 of the fuel inlet pipe 28.

A radially outer side of the fuel inlet pipe 28 and a radially outer side of the third tubular member 23 are resin molded. A connector 291 is formed in this molded portion. Terminals 292 for supplying the electric power to the coil 35 are insert molded in the connector 291. A holder 29 is placed on a radially outer side of the coil 35. The holder 29 is shaped into a tubular form such that the holder 29 covers the coil 35.

The fuel, which is supplied from the inlet 282 of the fuel inlet pipe 28, flows through an inside of the adjusting pipe 27, the communication passage 612, the flow passage 400, the hole 411 and a gap between the first tubular member 21 and the shaft portion 41 and is guided into the inside of the injection nozzle 25. That is, a passage, which is formed from the inlet 282 of the fuel inlet pipe 28 to the gap between the first tubular member 21 and the needle 40, is a fuel passage 18 that guides the fuel to the inside of the injection nozzle 25.

Next, the operation of the fuel injection valve 1 will be described.

When the electric power is not supplied to the coil 35, the seal portion 42 of the needle 40 contacts the valve seat 255. At this time, the needle 40, the movable core 50 and the flange receiving member 60 are placed to have a positional relationship shown in FIG. 2. Specifically, since the magnetic attractive force is not generated between the stationary core 30 and the movable core 50, the gap is present between the stationary core 30 and the movable core 50. Furthermore, the circular plate portion 61 contacts the shaft portion 41 and the flange 43, and the tubular portion 62 contacts the movable core 50. Thereby, the gap 430 is formed. The gap 430 is filled with the fuel that flows in the fuel passage 18.

Figure 4:
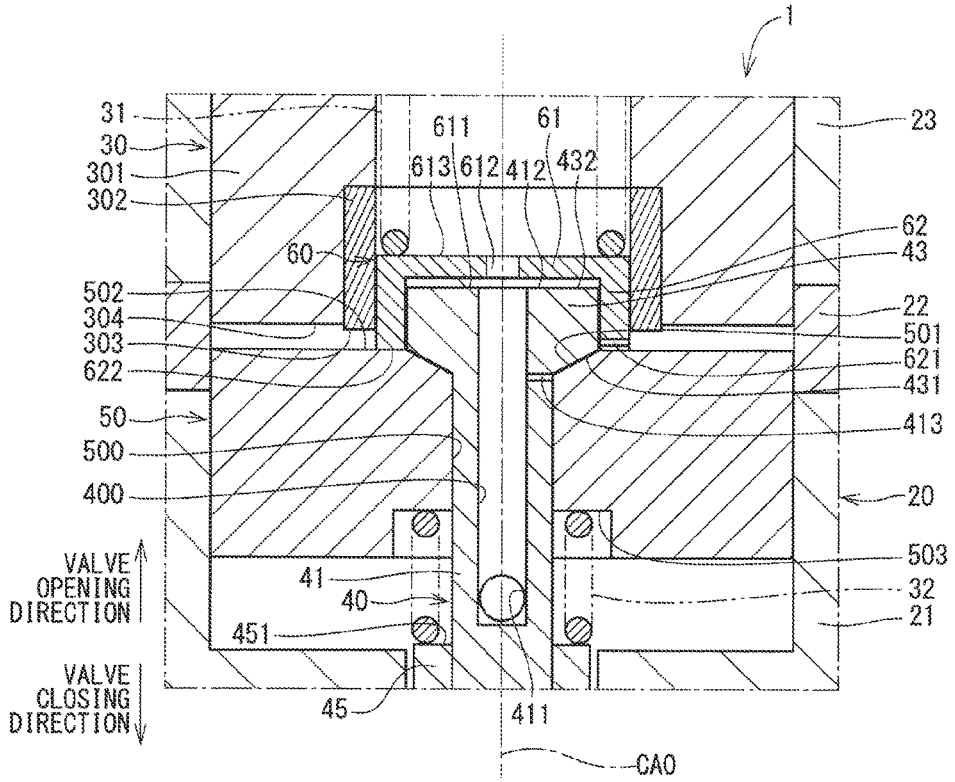
FIG. 4 is a cross sectional view for describing an operational state of the fuel injection valve according to the first embodiment of the present disclosure, which is different from the operational state of FIG. 2.

When the magnetic attractive force is generated between the stationary core 30 and the movable core 50 at the time of supplying the electric power to the coil 35, the movable core 50 is moved in the valve opening direction while the movable core 50 is accelerated through a distance that corresponds to a length of the gap 430 in the direction of the central axis CAO. Thereby, the movable core first contact surface 501 abuts against the flange member end surface 431, as shown in FIG. 4. At this time, the fuel in the gap 430 is outputted to the flow passage 400 through the needle communication passage 413 and is also quickly outputted to the outside of the flange receiving member 60 through the communication passage 621.

Figure 5:
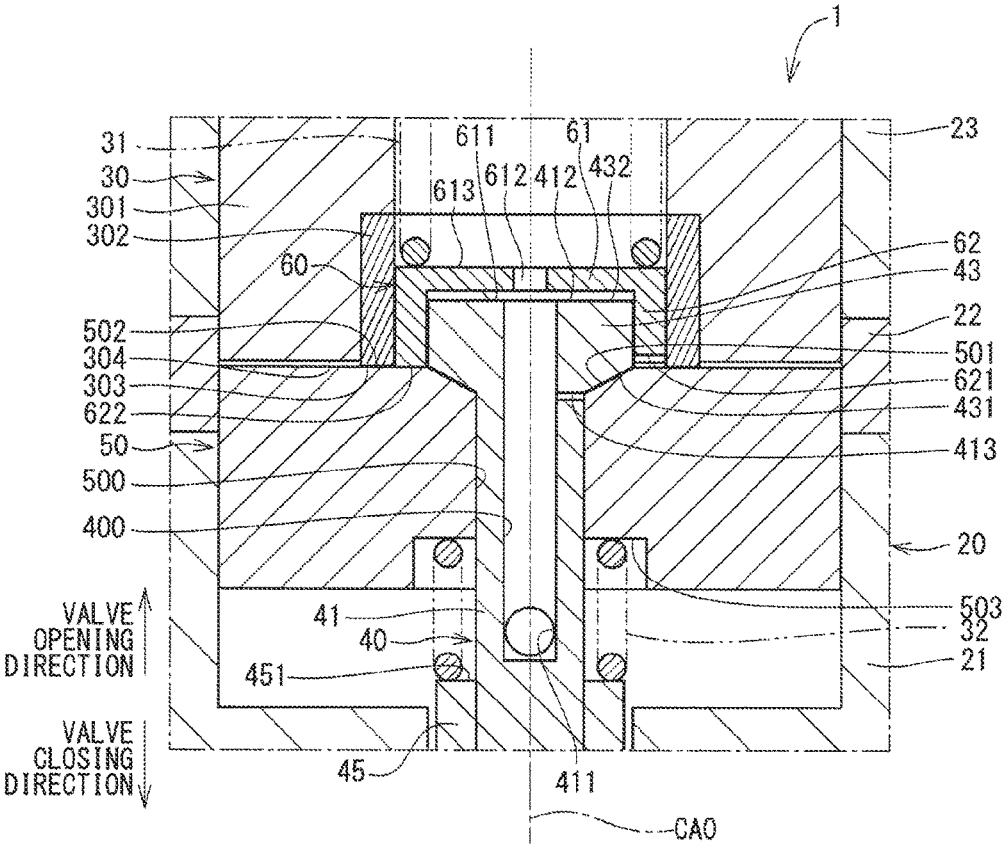
FIG. 5 is a cross sectional view for describing another operational state of the fuel injection valve according to the first embodiment of the present disclosure, which is different from the operational states of FIGS. 2 and 4.

Furthermore, the movable core 50 is moved in the valve opening direction while the contact between the movable core first contact surface 501 and the flange member end surface 431 is maintained. In this way, the seal portion 42 is lifted away from the valve seat 255, and thereby the injection holes 26 are opened. When the injection holes 26 are opened, the fuel, which is guided to the inside of the injection nozzle 25, is injected to the outside through the injection holes 26. As shown in FIG. 5, when the movable core 50, which is moved in the valve opening direction, abuts against the stationary core slidable portion 302, the movement of the movable core 50 in the valve opening direction is stopped. The needle 40 is urged by the second spring 32 such that the flange member end surface 431 contacts the movable core first contact surface 501. Therefore, at the time of injecting the fuel from the injection holes 26, the needle 40 and the movable core 50 are held to maintain the positional relationship shown in FIG. 5.

When the supply of the electric power to the coil 35 is stopped, the magnetic attractive force, which is generated between the stationary core 30 and the movable core 50, is lost. Thereby, the movable core 50 and the flange receiving member 60 are moved in the valve closing direction by the urging force of the first spring 31. When the movable core 50 and the flange receiving member 60 are moved in the valve closing direction, the end surface 412 and the end surface 432 abut against the end surface 611. Thereby, the needle 40 is moved in the valve closing direction along with the movable core 50 and the flange receiving member 60.

When the seal portion 42 abuts against the valve seat 255 upon movement of the needle 40 in the valve closing direction, the injection holes 26 are closed. Thereby, the injection of the fuel is terminated. The movement of the movable core 50, which is moved in the valve closing direction by an inertial force after the abutment of the seal portion 42 against the valve seat 255, is limited by the second spring 32.

(a) In the fuel injection valve 1 of the first embodiment, the gap 430 is formed by the flange member end surface 431 of the needle 40 and the movable core first contact surface 501 of the movable core 50 in the state where the seal portion 42 contacts the valve seat 255. In the fuel injection valve 1, when the electric power is supplied to the coil 35, the movable core 50 is accelerated through the distance that corresponds to the length of the gap 430 in the direction of the central axis CAO and abuts against the needle 40. In this way, in the fuel injection valve 1, a relatively large force in the valve opening direction can be exerted against the needle 40.

Furthermore, the fuel injection valve 1 includes the flange receiving member 60, which reciprocatably receives the flange 43. In the movable core of the injection valve, which abuts against the needle upon the acceleration of the movable core through the predetermined distance at the valve opening time, the space, which reciprocatably receives the flange, is not required. Therefore, the movable core 50 can have a relatively simple shape. In this way, the wear resistant film, which has an appropriate film thickness, can be formed on the movable core first contact surface 501 of the movable core 50 that abuts against the flange 43 at the valve opening time. Thereby, wearing of the movable core 50 can be limited. Thus, by limiting the wearing of the movable core 50, the force exerted against the needle 40 in the valve opening direction can be increased while the secular change of the injection characteristic is minimized.

(c) Furthermore, when the movable core 50 has the relatively simple shape, the durability of the movable core 50 against the collision shock, which is generated through the abutment of the movable core 50 against the needle 40, is improved. Therefore, the appropriate plating film can be formed on the surface of the movable core 50 in a simple and easy manner. Thereby, the manufacturing costs of the fuel injection valve 1 can be reduced.

(d) The circular plate portion 61 and the tubular portion 62 of the flange receiving member 60 are formed integrally as the one-piece body. Thereby, the number of components of the fuel injection valve 1 can be reduced in comparison to the case where the contact member and the leg member are formed separately from each other.

(e) The tubular portion 62 is shaped into the tubular form. Thereby, the number of components can be reduced in comparison to the case where the leg member is made of a plurality of leg members. Furthermore, since the shape of the flange receiving member 60 is simple, the manufacturing of the flange receiving member 60, which includes the tubular portion 62, can be eased. Thereby, the manufacturing costs of the fuel injection valve 1 can be further reduced.

(f) In the fuel injection valve 1, the radially outer side outer wall of the flange 43 and the inner wall of the tubular portion 62 are slidable relative to each other. Furthermore, the outer wall of the tubular portion 62 and the inner wall of the stationary core slidable portion 302 are slidable relative to each other. In this way, the reciprocation of the needle 40 in the housing 20 is guided, and unintentional injection of the fuel, which would be otherwise caused by inappropriate orientation of the needle 40, such as tilting of the needle 40, can be limited.

(g) In the fuel injection valve 1, the tubular portion 62 is shaped into the tubular form. Therefore, at the time of abutment between the flange member end surface 431 and the movable core first contact surface 501, the outflow of the fuel of the gap 430 is limited. The tubular portion 62 of the fuel injection valve 1 has the communication passage 621 that is communicatable with the gap 430. When the movable core 50 is moved in the valve opening direction, the fuel of the gap 430 is quickly outputted to the outside through the communication passage 621. In this way, it is possible to limit occurrence of the reduction of the moving speed of the movable core 50 by the fuel in the gap 430 before abutment of the movable core 50 against the needle 40.

(h) Furthermore, the shaft portion 41 has the needle communication passage 413 that is communicatable with the gap 430. When the movable core 50 is moved in the valve opening direction, the fuel of the gap 430 is quickly outputted to the flow passage 400 through the needle communication passage 413. Therefore, it is possible to limit the reduction of the moving speed of the movable core 50 by the fuel in the gap 430 before the abutment of the movable core 50 against the needle 40.

(i) In the fuel injection valve 1 the cross sectional area of the communication passage 612 of the circular plate portion 61 is smaller than the cross sectional area of the flow passage 400 of the shaft portion 41. Thereby, the fuel, which flows in the inside of the stationary core 30, is restricted once by the communication passage 612 and is thereafter supplied to the flow passage 400. Thus, pulsation of the fuel, which flows in the fuel passage 18, can be reduced.

(j) The fuel injection valve 1 includes the stationary core slidable portion 302, which has the hardness that is generally equal to the hardness of the flange receiving member 60 and the hardness of the movable core 50. Thereby, it is possible to limit occurrence of wearing or a damage of the stationary core main body 301, which would occur through slide movement between the stationary core main body 301 and the flange receiving member 60 or abutment of the movable core 50 against the stationary core main body 301 at the time of opening and closing the fuel injection valve 1. Therefore, the secular change of the injection characteristic of the fuel injection valve 1 can be further reduced.

(k) In the fuel injection valve 1, the movable core first contact surface 501 is urged against the flange member end surface 431 by the second spring 32 placed between the movable core third contact surface 503 of the movable core 50 and the end surface 451 of the spring seat 45 of the needle 40. In this way, it is possible to maintain the contact state of the needle 40 with the movable core 50 during the time of injecting the fuel from the injection holes 26 after the lifting of the needle 40 from the valve seat 255. Thus, it is possible to maintain the constant position of the needle 40 relative to the valve seat 255 during the time of injecting the fuel from the injection holes 26, and thereby it is possible to limit occurrence of abrupt change in the fuel injection quantity, which would be caused by a change in the lift amount of the needle 40.

(l) The second spring 32 urges the movable core 50 in the valve opening direction. Thereby, it is possible to limit excess movement of the movable core 50 in the valve closing direction after the abutment of the needle 40 against the valve seat 255. Therefore, it is possible to limit unintentional fuel injection, which would be caused by rebound of the movable core 50.

(Second Embodiment)

Figure 6:
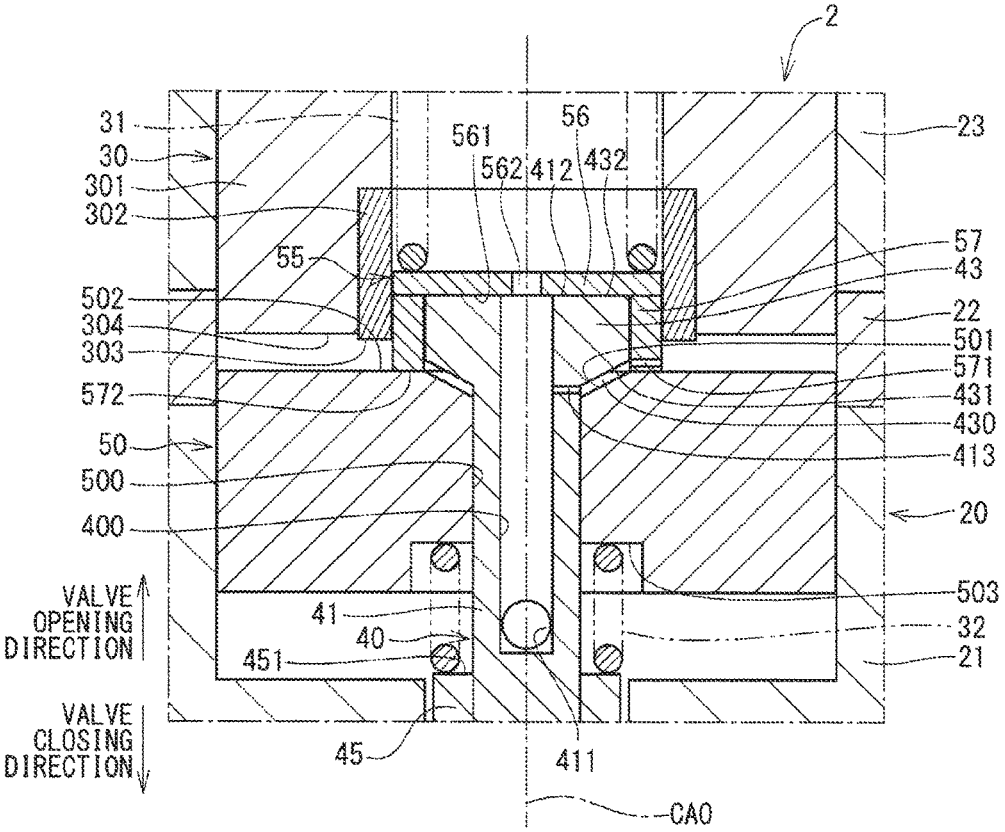
FIG. 6 is a cross sectional view of a fuel injection valve according to a second embodiment of the present disclosure.

Next, a fuel injection valve according to a second embodiment of the present disclosure will be described with reference to FIG. 6. The second embodiment differs from the first embodiment with respect to the structure of the flange receiving member. Here, components, which are substantially the same as those of the first embodiment, will be indicated by the same reference signs and will not be described for the sake of simplicity. FIG. 6 indicates the valve opening direction, which is the lifting direction of the needle 40 away from the valve seat 255, and the valve closing direction, which is the seating direction of the needle 40 against the valve seat 255.

In the fuel injection valve 2 of the second embodiment, the flange receiving member 55, which is reciprocatable and is placed on the opposite side of the movable core 50 that is opposite from the valve seat 255, includes a circular plate member (serving as a contact member) 56 and the leg member 57. In the second embodiment, the circular plate member 56 and the leg member 57 are formed separately from each other.

The circular plate member 56 is located on the opposite side of the flange 43, which is opposite from the valve seat 255. The circular plate member 56 includes an end surface 561 that is abuttable against the end surface 412 of the shaft portion 41 and the end surface 432 of the flange 43. The circular plate member 56 includes a communication passage (serving as a contact member communication passage) 562, which extends through the circular plate member 56 in the direction of the central axis CAO. The communication passage 562 communicates between the outside of the flange receiving member 55 and the flow passage 400.

The leg member 57 is a tubular member that is located on the side of the circular plate member 56 where the valve seat 255 is placed. An inner wall of the leg member 57 is slidable relative to the radially outer side outer wall of the flange 43. Furthermore, an outer wall of the leg member 57 is slidable relative to the inner wall of the stationary core slidable portion 302. The leg member 57 contacts the circular plate member 56. An opposite end part of the leg member 57, which is opposite from the end part of the leg member 57 that contacts the circular plate member 56, is abuttable against the movable core 50. Specifically, an end surface 572 of the leg member 57 is abuttable against the movable core second contact surface 502. The leg member 57 has a length that enables reciprocation of the flange 43 in the inside of the flange receiving member 55.

The leg member 57 includes a communication passage (serving as a leg member communication passage) 571 that communicates between the inside and the outside of the leg member 57. The communication passage 571 is communicatable with the gap 430, which is formed in the inside of the leg member 57.

In the fuel injection valve 2 of the second embodiment, the circular plate member 56 and the leg member 57 are formed separately from each other. That is, the flange receiving member 55 is made of the two members, which have the relatively simple shapes, respectively. Thereby, the leg member 57, which defines the reciprocatable distance of the flange 43, can be highly accurately processed. Thus, the second embodiment can achieve the advantages (a)-(c), (g)-(l) of the first embodiment and can achieve another advantage (m) of that the force in the valve opening direction exerted to the needle 40 at the valve opening time can be accurately set.

(Third Embodiment)

Figure 7:
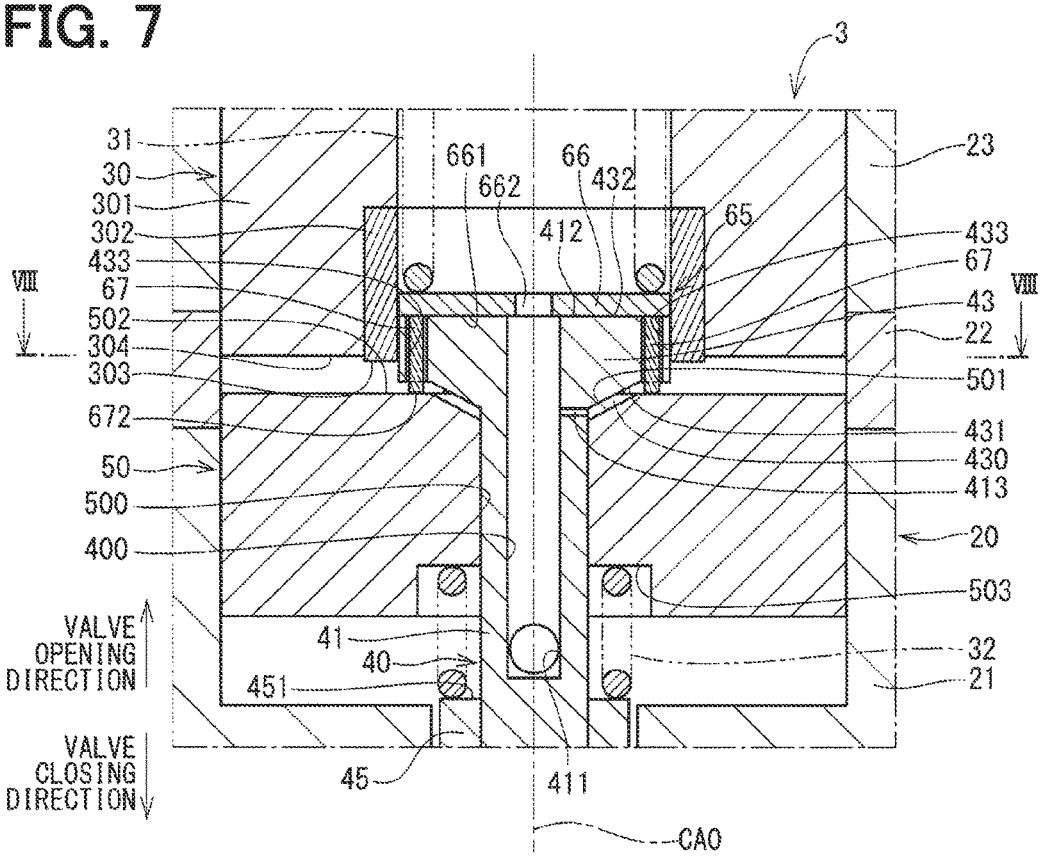
FIG. 7 is a cross sectional view of a fuel injection valve according to a third embodiment of the present disclosure.

Next, a fuel injection valve according to a third embodiment of the present disclosure will be described with reference to FIGS. 7 and 8. The third embodiment differs from the first embodiment with respect to the shape of the flange receiving member. Here, components, which are substantially the same as those of the first embodiment, will be indicated by the same reference signs and will not be described for the sake of simplicity. FIG. 7 indicates the valve opening direction, which is the lifting direction of the needle 40 away from the valve seat 255, and the valve closing direction, which is the seating direction of the needle 40 against the valve seat 255.

In the fuel injection valve 3 of the third embodiment, the flange receiving member 65 includes a circular plate member (serving as a contact member) 66 and a plurality of leg members 67. In the third embodiment, the circular plate member 66 and the leg members 67 are formed separately from each other.

The circular plate member 66 includes an end surface 661 that is abuttable against the end surface 412 and the end surface 432. The circular plate member 66 includes a communication passage (serving as a contact member communication passage) 662, which extends through the circular plate member 66 in the direction of the central axis CAO. The communication passage 662 communicates between the outside of the flange receiving member 65 and the flow passage 400. As shown in FIG. 7, a cross sectional area of the communication passage 662 is smaller than the cross sectional area of the flow passage 400.

Figure 8:
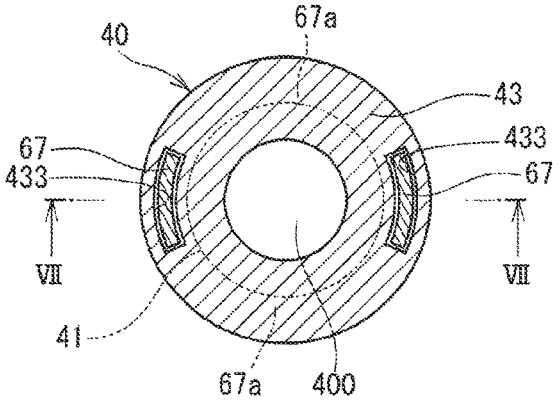
FIG. 8 is a cross sectional view of a flange receiving member of the fuel injection valve according to the third embodiment of the present disclosure.

As shown in FIG. 8, the leg members 67 are members, each of which has a cross section that is perpendicular to the central axis CAO and is shaped into an arcuate form. The leg members 67 are received through flange member insertion holes 433. Each of the flange member insertion holes 433 communicates between the flange member end surface 431, which is formed in the radially outer side end part of the flange 43, and the end surface 432 of the flange 43. Gaps 67*a*, each of which is circumferentially located between the circumferentially adjacent leg members 67, serve as leg member communication passages that communicate between the gap 430 and the outside of the flange receiving member 65 in the radial direction.

The leg members 67 contact the end surface 661 of the circular plate member 66. An end surface 672 of an end part of each leg member 67, which is placed on the movable core 50 side, is abuttable against the movable core second contact surface 502. Each leg member 67 has a length that enables reciprocation of the flange 43 in the inside of the flange receiving member 65.

In the fuel injection valve 3 of the third embodiment, the circular plate member 66 and the leg members 67 are formed separately from each other. That is, the flange receiving member 65 is made of the two types of members, which have the relatively simple shapes, respectively. Thereby, the leg members 67, which define the reciprocatable distance of the flange 43, can be highly accurately processed. Thus, the third embodiment can achieve the advantages (a)-(c), (g)-(l) of the first embodiment and can achieve the advantage (m) of the second embodiment.

(Fourth Embodiment)

Figure 9:
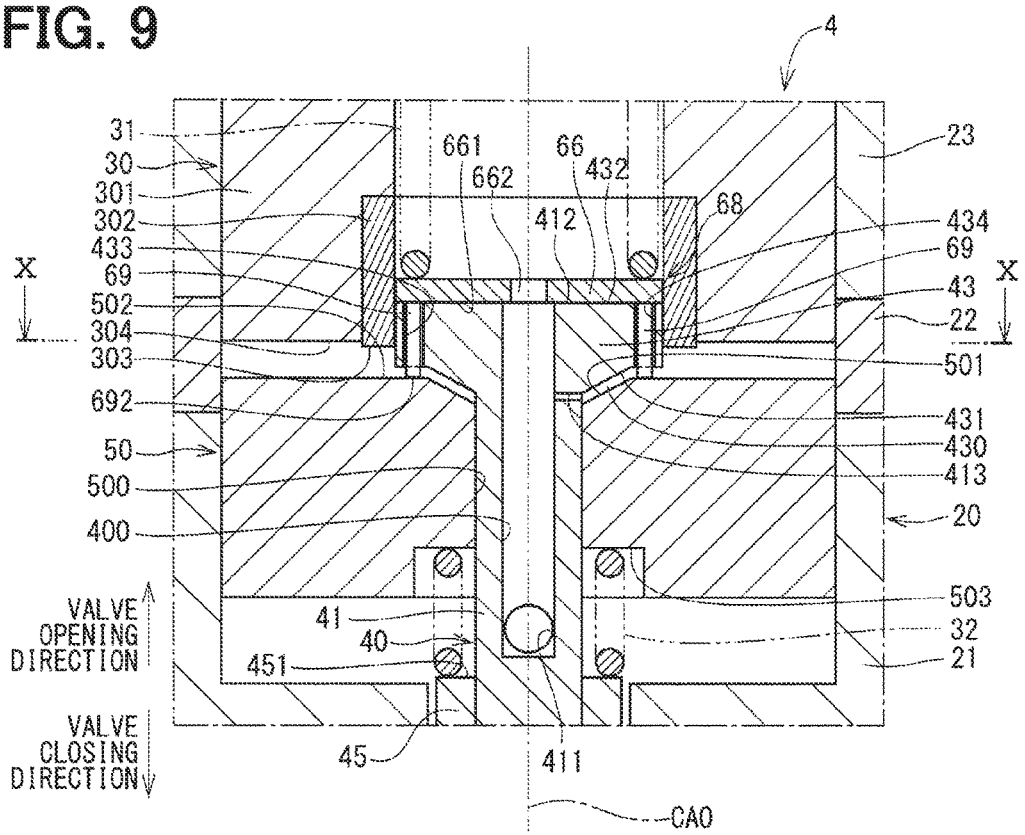
FIG. 9 is a cross sectional view of a fuel injection valve according to a fourth embodiment of the present disclosure.

Next, a fourth embodiment of the present disclosure will be described with reference to FIGS. 9 and 10. The fourth embodiment differs from the third embodiment with respect to the shape of leg members. Here, components, which are substantially the same as those of the third embodiment, will be indicated by the same reference signs and will not be described for the sake of simplicity. FIG. 9 indicates the valve opening direction, which is the lifting direction of the needle 40 away from the valve seat 255, and the valve closing direction, which is the seating direction of the needle 40 against the valve seat 255.

In the fuel injection valve 4 of the fourth embodiment, the flange receiving member 68 includes the circular plate member 66 and a plurality of leg members 69.

Figure 10:
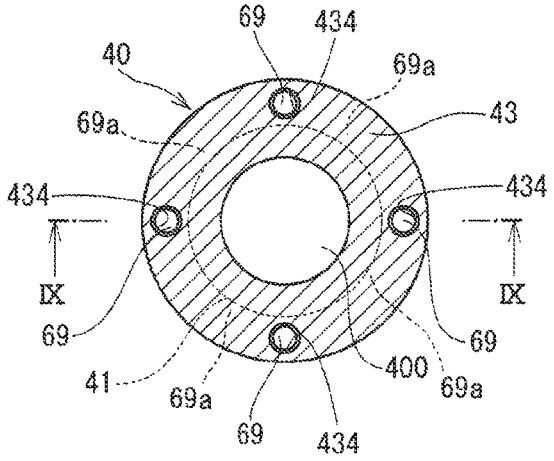
FIG. 10 is a cross sectional view of a flange receiving member of the fuel injection valve according to the fourth embodiment of the present disclosure.

As shown in FIG. 10, the leg members 69 are multiple cylindrical members, each of which has a cross section that is perpendicular to the central axis CAO and is shaped into a circular form. In the fourth embodiment, the number of the leg members 69 is four. The leg members 69 are received through flange member insertion holes 434. Each of the flange member insertion holes 434 communicates between the flange member end surface 431, which is formed in the radially outer side end part of the flange 43, and the end surface 432 of the flange 43. Gaps 69*a*, each of which is circumferentially located between the circumferentially adjacent leg members 69, serve as leg member communication passages that communicate between the gap 430 and the outside of the flange receiving member 68 in the radial direction.

The leg members 69 contact the end surface 661 of the circular plate member 66. An end surface 692 of an end part of each leg member 69, which is placed on the movable core 50 side, is abuttable against the movable core second contact surface 502. Each leg member 69 has a length that enables reciprocation of the flange 43 in the inside of the flange receiving member 68.

In the fuel injection valve 4 of the fourth embodiment, the circular plate member 66 and the leg members 69 are formed separately from each other. That is, the flange receiving member 68 is made of the two types of members, which have the relatively simple shapes, respectively. Thereby, the leg members 69, which define the reciprocatable distance of the flange 43, can be highly accurately processed. Thus, the fourth embodiment can achieve the advantages (a)-(c), (g)-(l) of the first embodiment and can achieve the advantage (m) of the second embodiment.

(Fifth Embodiment)

Figure 11:
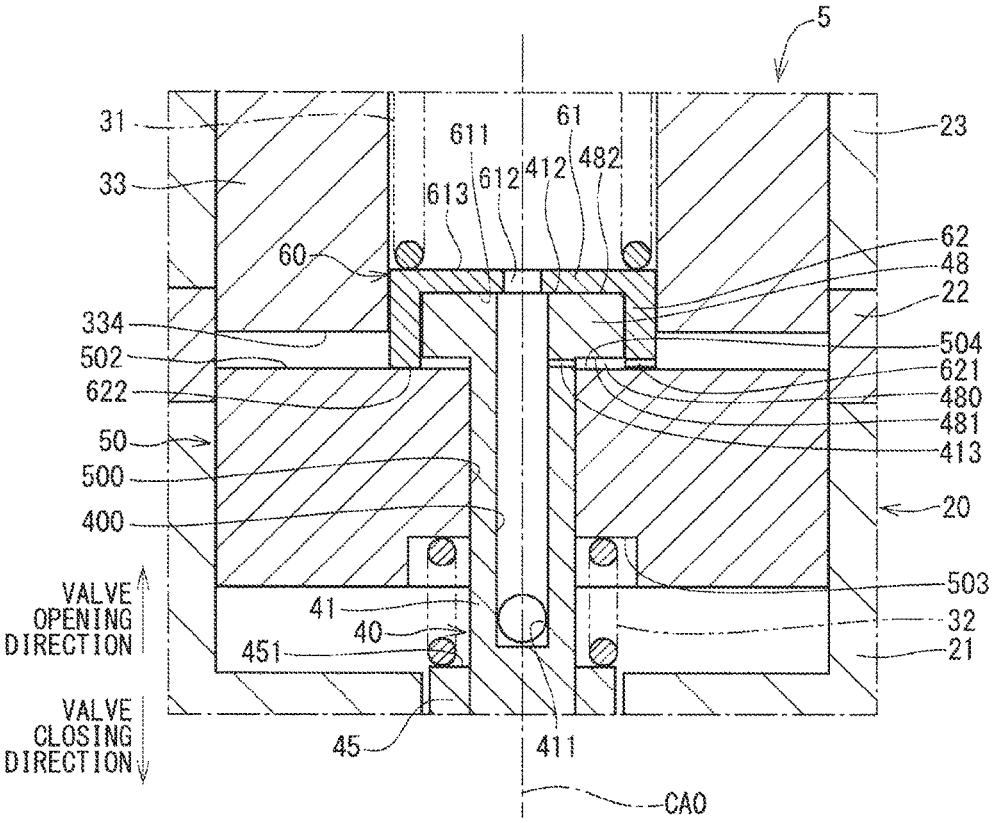
FIG. 11 is a cross sectional view of a fuel injection valve according to a fifth embodiment of the present disclosure.

Next, a fuel injection valve according to a fifth embodiment of the present disclosure will be described with reference to FIG. 11. The fifth embodiment differs from the first embodiment with respect to the shape of the movable core and the shape of the flange. Here, components, which are substantially the same as those of the first embodiment, will be indicated by the same reference signs and will not be described for the sake of simplicity. FIG. 11 indicates the valve opening direction, which is the lifting direction of the needle 40 away from the valve seat 255, and the valve closing direction, which is the seating direction of the needle 40 against the valve seat 255.

In the fuel injection valve 5 of the fifth embodiment, the flange (serving as the flange member) 48 of the needle 40 is shaped into a circular ring form. Specifically, the flange member end surface 481 of the flange 48, which is located on the valve seat 255 side and is abuttable against the movable core 50, extends perpendicular to the central axis CAO. Here, the meaning of "perpendicular" is not limited to its strict sense but also includes an angle(s) that can be visually recognizable as "perpendicular". Furthermore, a movable core fourth contact surface 504 of the movable core 50, which is opposed to the flange member end surface 481, also extends perpendicular to the central axis CAO. That is, the movable core 50 of the fifth embodiment is formed such that the movable core first contact surface 501 and the movable core second contact surface 502 of the first embodiment are formed in a common plane.

The end surface 412 of the shaft portion 41 and an end surface (serving as an end surface of the flange member, which is opposite from the valve seat) 482 of the flange 48, which are opposite from the valve seat 255, are abuttable against the end surface 611 of the circular plate portion 61.

As shown in FIG. 11, in the state where the circular plate portion 61 abuts against the shaft portion 41 and the flange 48, and the tubular portion 62 abuts against the movable core 50, a gap 480 is formed by the flange member end surface 481 and the movable core fourth contact surface 504. At this time, the gap 480 is communicated with the needle communication passage 413 and the communication passage 621. That is, the movable core fourth contact surface 504 serves as "a movable core contact surface" and "an end surface of the movable core, which is opposite from the valve seat."

Furthermore, in the fuel injection valve 5, the stationary core 33 is shaped into a tubular form. The tubular portion 62 is slidable with an inner wall of the stationary core 33. When the movable core 50 is magnetically attracted to the stationary core 33, the movable core second contact surface 502 of the movable core 50 abuts against the end surface 334 of the stationary core 33, which is located on the valve seat 255 side.

In the fuel injection valve 5 of the fifth embodiment, the movable core fourth contact surface 504 extends perpendicular to the central axis CAO. Furthermore, the flange member end surface 481 of the flange 48 extends perpendicular to the central axis CAO in such a manner that the flange member end surface 481 is opposed to the movable core fourth contact surface 504. In this way, the fifth embodiment can achieve the advantages of the first embodiment and an advantage (n) of the fifth embodiment of that the number of manufacturing steps required for processing of the needle 40 and the movable core 50 is reduced in comparison to the first embodiment, and thereby the manufacturing costs of the fuel injection valve 5 can be further reduced.

(Sixth Embodiment)

Figure 12:
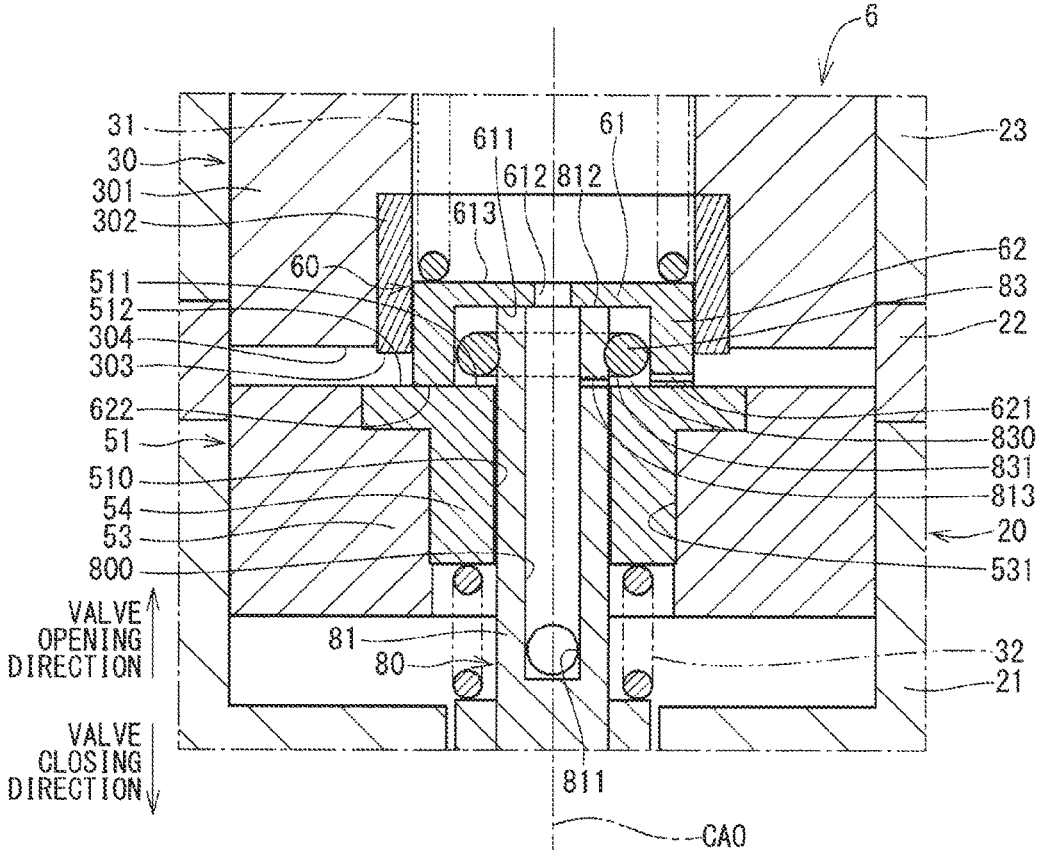
FIG. 12 is a cross sectional view of a fuel injection valve according to a sixth embodiment of the present disclosure.

Next, a fuel injection valve according to a sixth embodiment of the present disclosure will be described with reference to FIG. 12. The sixth embodiment differs from the first embodiment with respect to the shape of the needle and the shape of the movable core. Here, components, which are substantially the same as those of the first embodiment, will be indicated by the same reference signs and will not be described for the sake of simplicity. FIG. 12 indicates the valve opening direction, which is the lifting direction of the needle 80 away from the valve seat 255, and the valve closing direction, which is the seating direction of the needle 80 against the valve seat 255.

In the fuel injection valve 6 of the sixth embodiment, the needle 80 includes a shaft member (serving as a needle member) 81, the seal portion 42 and a flange member 83. The shaft member 81 is formed separately from the flange member 83.

The shaft member 81 is a rod member that has an end part, which is located on the stationary core 30 side and is shaped into a tubular form. A flow passage 800, which conducts fuel directed toward the injection nozzle 25, is formed in an inside of the end part of the shaft member 81 located on the stationary core 30 side. The flow passage 800 is communicated with a hole 811 of the shaft member 81 at the valve seat 255 side of the flow passage 800. The seal portion 42, which is abuttable against the valve seat 255, is formed at the end part of the shaft member 81, which is located on the side opposite from the stationary core 30. An end surface (serving as an end surface of the needle member that is opposite from the valve seat) 812 of the shaft member 81, which is opposite from the valve seat 255, is abuttable against the end surface 611 of the circular plate portion 61. Furthermore, the shaft member 81 has a needle communication passage 813 that is communicated with a gap 830 described later.

The flange member 83 is shaped into a generally circular ring form. The flange member 83 is fixed, for example, by press fitting to an opposite end part of the shaft member 81 that is opposite from an end part of the shaft member 81, at which the seal portion 42 is formed. A radially outer side outer wall of the flange member 83 is slidable with the inner wall of the tubular portion 62.

The movable core 51 includes a movable core main body 53 and a movable core slidable portion 54. The movable core main body 53 and the movable core slidable portion 54 are formed separately from each other.

The movable core main body 53 is made of a magnetic material, such as ferritic stainless steel, and is shaped into a tubular form. The movable core main body 53 is reciprocatable relative to a portion of the housing 20, which is located on the side of the stationary core 30 where the valve seat 255 is placed. An insertion hole 531 extends in the direction of the central axis in the movable core main body 53.

The movable core slidable portion 54 is inserted into the insertion hole 531 of the movable core main body 53 and is fixed to the movable core main body 53 by, for example, press fitting. The movable core slidable portion 54 is made of a metal material that has a degree of hardness, which is generally equal to a degree of hardness of the shaft member 81, a degree of hardness of the flange member 83 and a degree of hardness of the tubular portion 62, and the movable core slidable portion 54 is shaped into a generally tubular form. An inner wall of the movable core slidable portion 54 forms a movable core through hole 510, through which the shaft member 81 is inserted. A movable core first contact surface (serving as a movable core contact surface) 511, which is opposed to the flange member end surface 831, is formed in an outer periphery of an opening of the movable core through hole 510, which is located on the stationary core 30 side. In the state where the circular plate portion 61 abuts against the shaft member 81, and the tubular portion 62 abuts against the movable core 51, the gap 830 is formed by the flange member end surface 831 and the movable core first contact surface 511.

A movable core second contact surface 512, which serves as an end surface of the movable core that is shaped into a ring form and is opposite from the valve seat, is formed on a radially outer side of the movable core first contact surface 511. The movable core second contact surface 512 is abuttable against the end surface 303 of the stationary core slidable portion 302 and the end surface 622 of the tubular portion 62. In the fourth embodiment, the movable core first contact surface 511 and the movable core second contact surface 512 extend perpendicular to the central axis CAO and are formed in a common plane.

In the fuel injection valve 6 of the sixth embodiment, the needle 80 includes the shaft member 81 and the flange member 83 while the flange member 83 is a separate member that is shaped into the circular ring form and is formed separately from the shaft member 81. In this way, the needle 40 can be formed by a combination of the members, which have the relatively simple shapes, respectively. Thus, the sixth embodiment can achieve the advantages (a)-(l) of the first embodiment and can achieve another advantage (o) of that the manufacturing costs of the needle 40 can be reduced.

The movable core slidable portion 54 includes the inner wall of the movable core through hole 550, which serves as a slidable portion that is slidable relative to the shaft member 81, and the movable core second contact surface 512, which is abuttable against the end surface 622 and the end surface 303. This movable core slidable portion 54 is formed separately from the movable core main body 53 that is made of the magnetic material. Thereby, it is possible to form only the movable core slidable portion 54 from the metal material, which has the degree of hardness that is generally equal to the degree of hardness of the shaft member 81, the degree of hardness of the flange member 83 and the degree of hardness of the tubular portion 62, so that it is possible to limit wearing of the movable core 51 that would occur through slide movement between the movable core 51 and the shaft member 81 or the abutment of the movable core 51 against the stationary core 30 and the flange receiving member 60. Thus, the sixth embodiment can achieve an advantage (p) of that the wearing of the movable core 50 is further limited, and the secular change of the injection characteristic of the fuel injection valve 4 can be further reduced.

(Seventh Embodiment)

Figure 13:
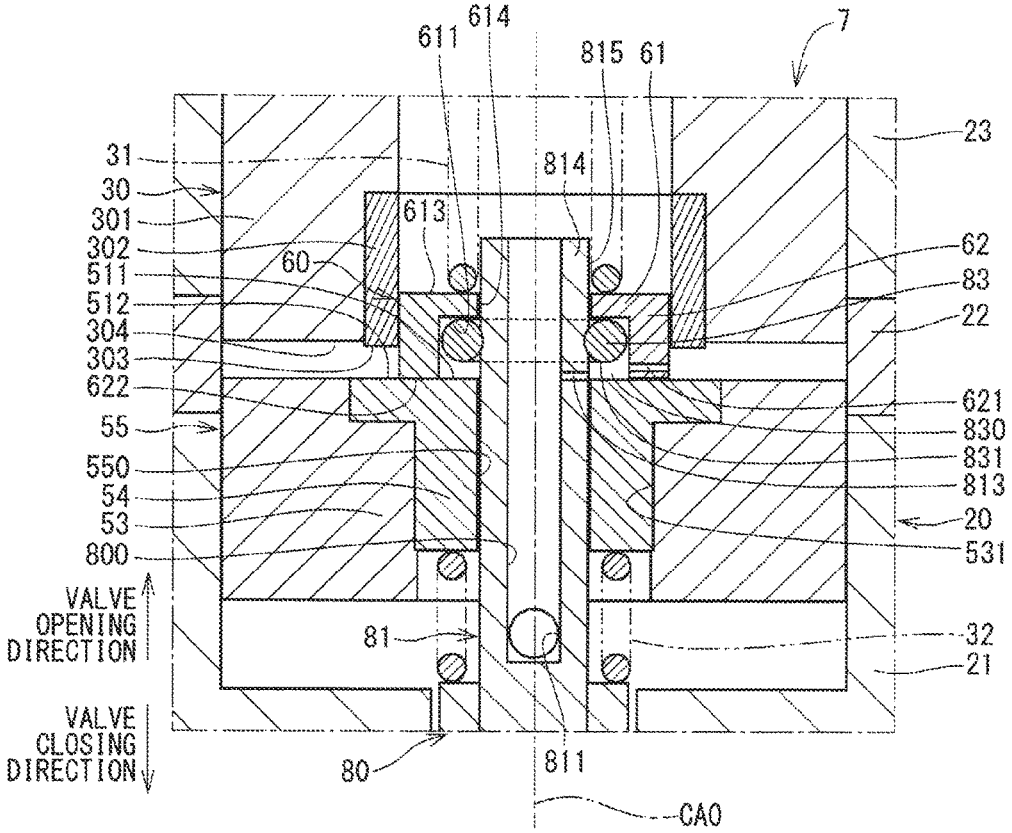
FIG. 13 is a cross sectional view of a fuel injection valve according to a seventh embodiment of the present disclosure.

Next, a fuel injection valve according to a seventh embodiment of the present disclosure will be described with reference to FIG. 13. The seventh embodiment differs from the sixth embodiment with respect to the shape of the shaft member of the needle. Here, components, which are substantially the same as those of the sixth embodiment, will be indicated by the same reference signs and will not be described for the sake of simplicity, FIG. 13 indicates the valve opening direction, which is the lifting direction of the needle 80 away from the valve seat 255, and the valve closing direction, which is the seating direction of the needle 80 against the valve seat 255.

In the fuel injection valve 7 of the seventh embodiment, the shaft member 81 of the needle 80 projects from the circular plate portion 61. Specifically, as shown in FIG. 13, the shaft member 81 is inserted through an insertion hole (serving as a contact member insertion hole) 614 of the circular plate portion 61. The end part of the first spring 31, which is supported by the circular plate portion 61, contacts a radially outer side outer wall 815 of an end part (serving as another end part of the needle member) 814 of the shaft member 81, which is opposite from the valve seat 255 and projects to the outside of the flange receiving member 60.

In the fuel injection valve 7 of the seventh embodiment, the reciprocation of the shaft member 81 is guided by an inner wall of the circular plate portion 61. The outer wall 815 of the shaft member 81 guides the expansion and contraction movement of the first spring 31. Thereby, the needle 80 can be reciprocated in a stable manner in the direction of the central axis CAO. Thus, the seventh embodiment can achieve the advantages (a)-(h), (j)-(l) of the first embodiment and the advantages (o), (p) of the sixth embodiment and can achieve another advantage (q) of that unintentional fuel injection, which would be otherwise caused by inappropriate orientation of the needle 40, can be limited.

(Eighth Embodiment)

Figure 14:
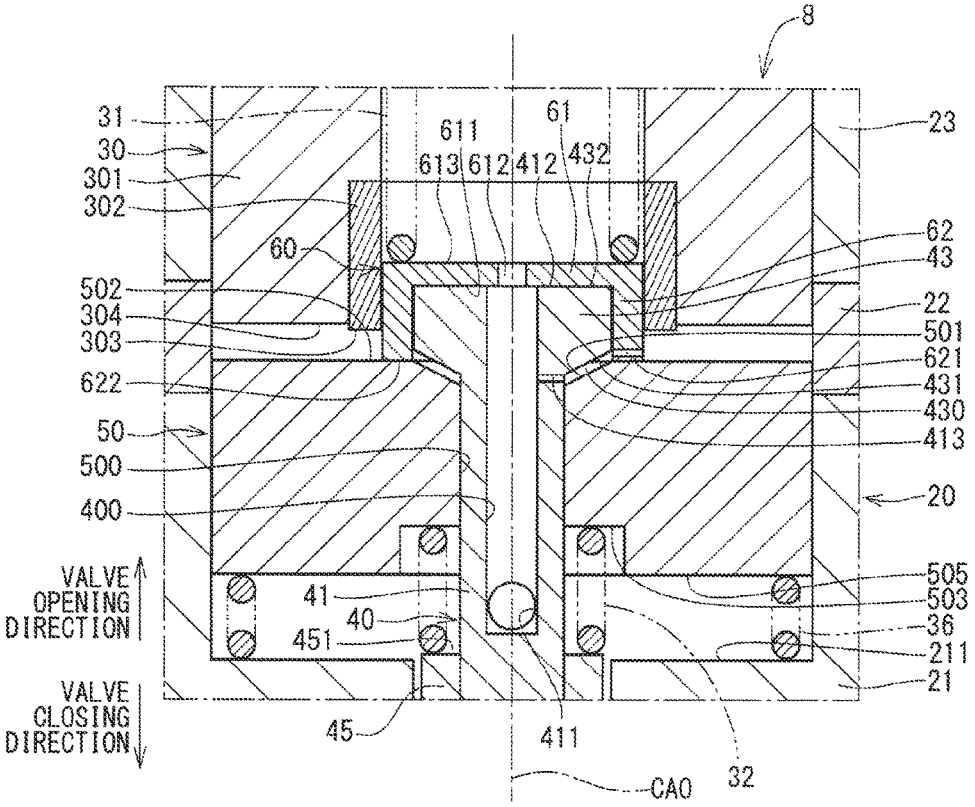
FIG. 14 is a cross sectional view of a fuel injection valve according to an eighth embodiment of the present disclosure.

Next, a fuel injection valve according to an eighth embodiment of the present disclosure will be described with reference to FIG. 14. The eighth embodiment differs from the first embodiment with respect to that an urging member is provided between the movable core and the housing. Here, components, which are substantially the same as those of the first embodiment, will be indicated by the same reference signs and will not be described for the sake of simplicity. FIG. 14 indicates the valve opening direction, which is the lifting direction of the needle 40 away from the valve seat 255, and the valve closing direction, which is the seating direction of the needle 40 against the valve seat 255.

In the fuel injection valve 8 of the eighth embodiment, a third spring (serving as a third urging member) 36 is provided between the movable core 50 and the first tubular member 21. One end part of the third spring 36 contacts a movable core fifth contact surface 505 that is an end surface of the movable core 50 located on the valve seat 255 side and is different from the movable core third contact surface 503, to which the second spring 32 contacts. The other end part of the third spring 36 contacts the inner wall 211 of the first tubular member 21. The third spring 36 urges the movable core 50 toward the stationary core 30 in such a manner that the movable core fifth contact surface 505 is spaced from the inner wall 211.

In the fuel injection valve 8 of the eighth embodiment, at the valve closing time, the movable core 50 is moved in the valve closing direction by the inertial force after the movement of the needle 40 is stopped through the abutment of the needle 40 against the valve seat 255. At this time, the moving speed of the movable core 50 in the valve closing direction is reduced by the urging force of the third spring 36. In this way, it is possible to limit occurrence of the rebound movement of the needle away from the valve seat in the valve opening direction after abutment of the movable core against, for example, the inner wall of the first tubular member. Therefore, the eighth embodiment can achieve the advantages (a)-(l) of the first embodiment and can achieve another advantage (r) of that unintentional fuel injection, which would be otherwise caused by of the rebound of the movable core 50, can be limited.

(Ninth Embodiment)

Figure 15:
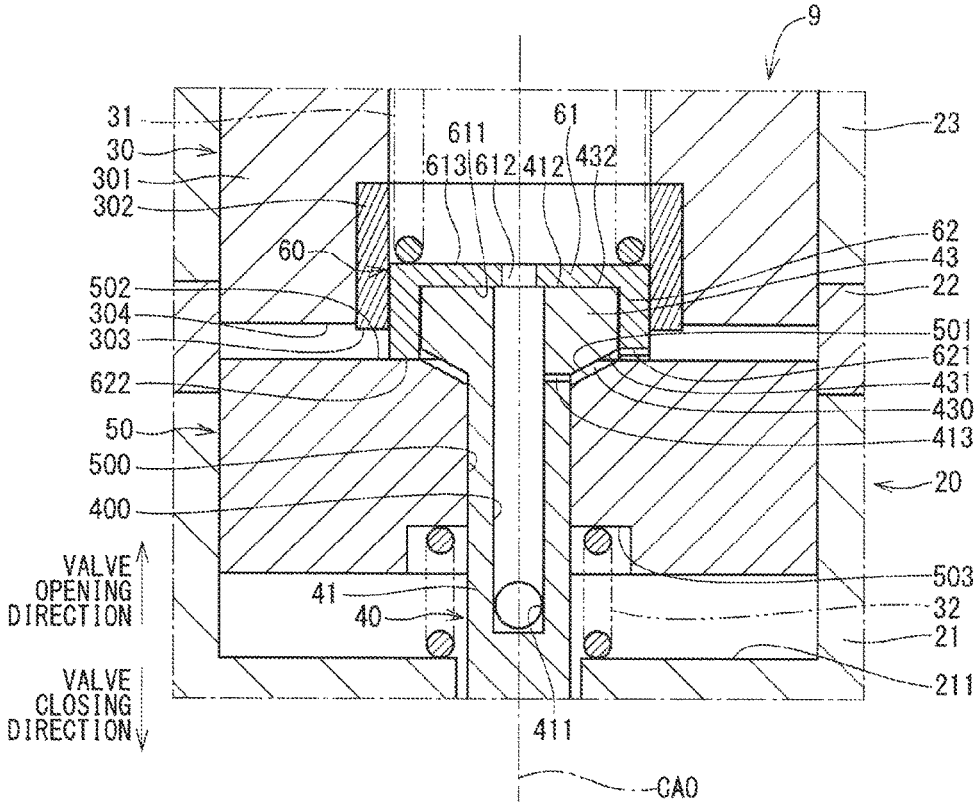
FIG. 15 is a cross sectional view of a fuel injection valve according to a ninth embodiment of the present disclosure.

Next, a fuel injection valve according to an ninth embodiment of the present disclosure will be described with reference to FIG. 15. The ninth embodiment differs from the first embodiment with respect to the portion, which supports the other end part of the second spring. Here, components, which are substantially the same as those of the first embodiment, will be indicated by the same reference signs and will not be described for the sake of simplicity. FIG. 15 indicates the valve opening direction, which is the lifting direction of the needle 40 away from the valve seat 255, and the valve closing direction, which is the seating direction of the needle 40 against the valve seat 255.

In the fuel injection valve 9 of the ninth embodiment, the second spring 32 is provided between the movable core 50 and the first tubular member 21. The one end part of the second spring 32 contacts the movable core third contact surface 503, The other end part of the second spring 32 contacts the inner wall 211 of the first tubular member 21. The second spring 32 urges the movable core 50 in such a manner that the movable core third contact surface 503 and the inner wall 211 are spaced from each other.

In the fuel injection valve 9 of the ninth embodiment, similar to the eighth embodiment, at the valve closing time, it is possible to limit occurrence of the rebound movement of the needle away from the valve seat in the valve opening direction after abutment of the movable core against, for example, the inner wall of the first tubular member. Thus, the ninth embodiment can achieve the advantages (a)-(l) of the first embodiment and can achieve the advantage (r) of the eighth embodiment. Furthermore, the spring seat, which is provided on the radially outer side of the shaft portion 41 in the fuel injection valve 1 of the first embodiment, is not required in the ninth embodiment. Therefore, the ninth embodiment can achieve an advantage (s) of that the number of steps required for the processing of the needle 40 can be reduced.

(Tenth Embodiment)

Figure 16:
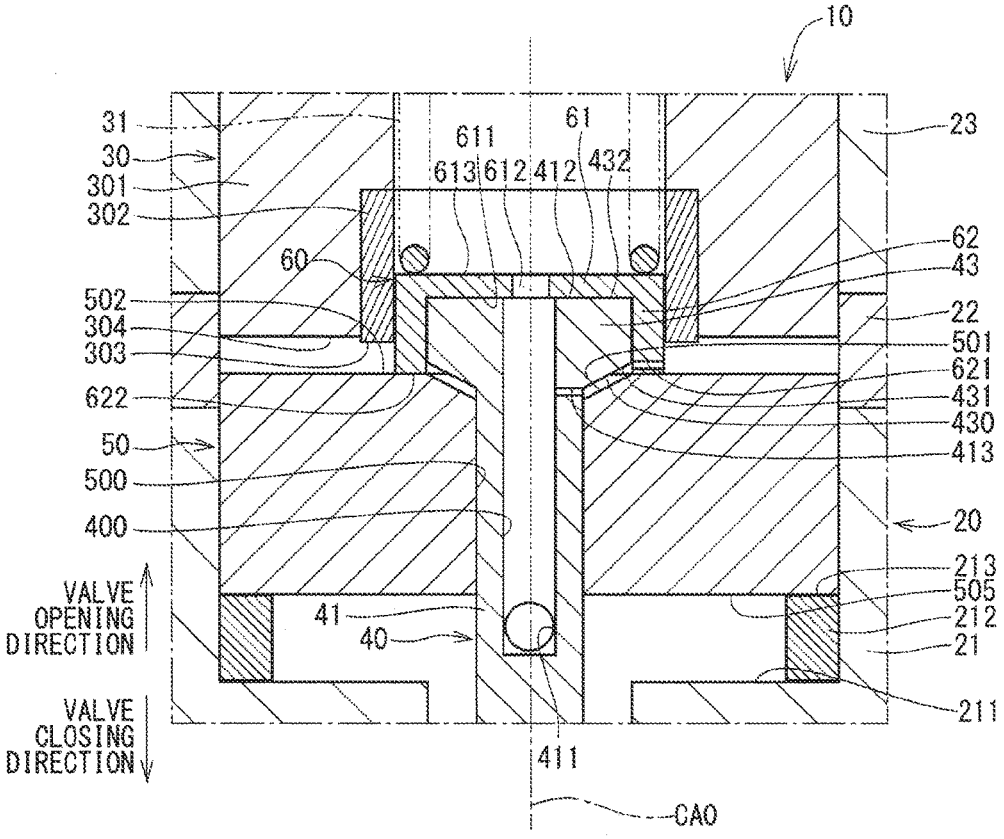
FIG. 16 is a cross sectional view of a fuel injection valve according to a tenth embodiment of the present disclosure.

Next, a fuel injection valve according to a tenth embodiment of the present disclosure will be described with reference to FIG. 16. The tenth embodiment differs from the first embodiment with respect to that a limiting member is provided to the inner wall of the housing. Here, components, which are substantially the same as those of the first embodiment, will be indicated by the same reference signs and will not be described for the sake of simplicity. FIG. 16 indicates the valve opening direction, which is the lifting direction of the needle 40 away from the valve seat 255, and the valve closing direction, which is the seating direction of the needle 40 against the valve seat 255.

In the fuel injection valve 10 of the tenth embodiment, the limiting member 212 is provided to the valve seat 255 side of the movable core 50. As shown in FIG. 16, the limiting member 212 is fixed to the inner wall 211 of the first tubular member 21. In the state where the circular plate portion 61 abuts against the shaft portion 41 and the flange 43, and the tubular portion 62 abuts against the movable core 50, the end surface 213 of the limiting member 212 abuts against the movable core fifth contact surface 505.

In the fuel injection valve 10 of the tenth embodiment, at the valve closing time, although the movable core 50 is urged to move in the valve closing direction by the inertial force after the stopping of the movement of the needle 40 through the abutment of the needle 40 against the valve seat 255, such a movement of the movable core 50 is limited by the limiting member 212. Thereby, it is possible to limit the rebound of the needle 40 away from the valve seat 255, which would be caused by the rebound of the movable core 50 toward the stationary core 30. Furthermore, the second spring and the spring seat of the first embodiment are not required. Thus, the tenth embodiment can achieve the advantages (a)-(l) of the first embodiment, the advantage (r) of the eighth embodiment and the advantage (s) of the ninth embodiment.

(Eleventh Embodiment)

Figure 17:
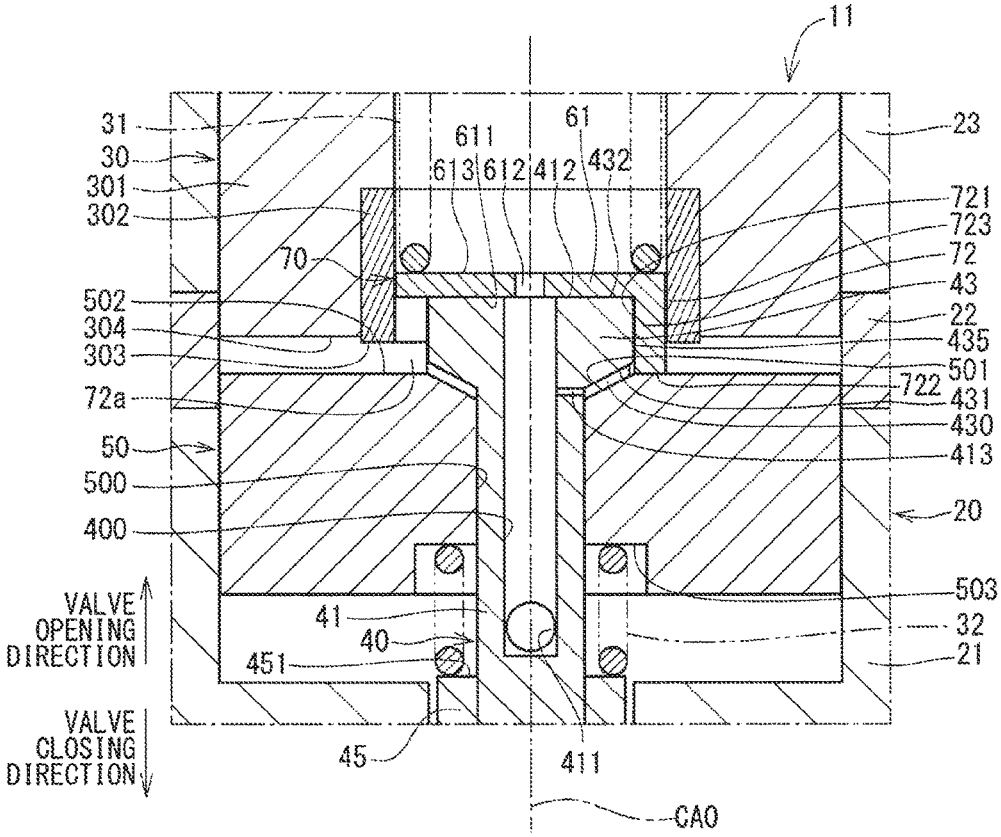
FIG. 17 is a cross sectional view of a fuel injection valve according to an eleventh embodiment of the present disclosure.
Figure 18:
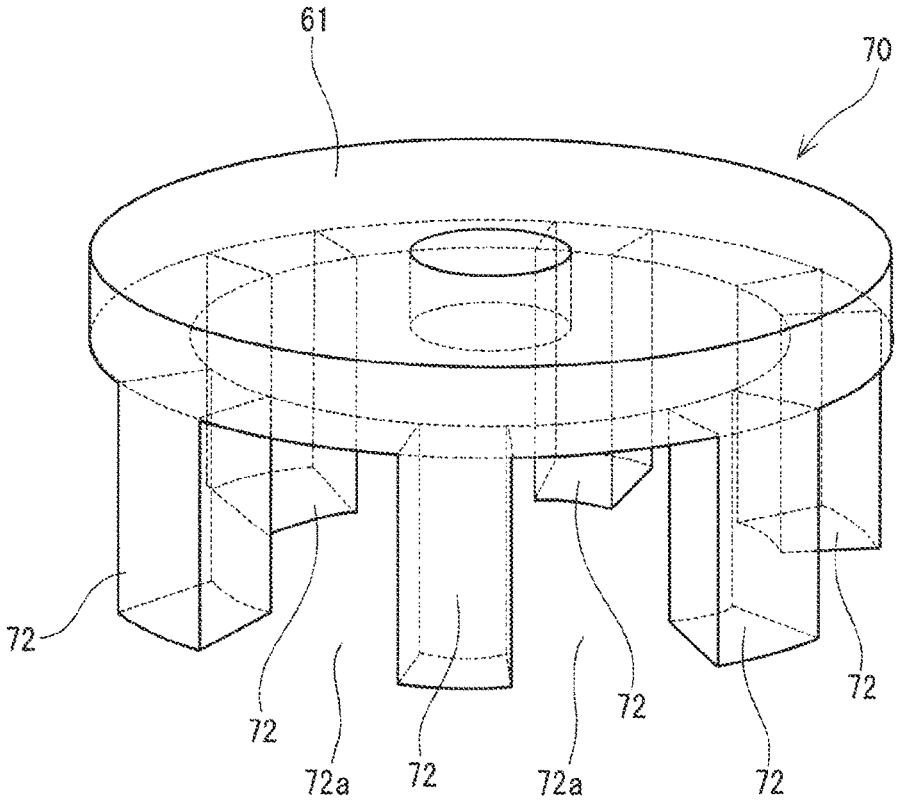
FIG. 18 is a perspective view of a flange receiving member of the fuel injection valve according to the eleventh embodiment of the present disclosure.

Next, a fuel injection valve according to an eleventh embodiment of the present disclosure will be described with reference to FIGS. 17 and 18. The eleventh embodiment differs from the first embodiment with respect to that the flange receiving member includes a plurality of legs. Here, components, which are substantially the same as those of the first embodiment, will be indicated by the same reference signs and will not be described for the sake of simplicity. FIG. 17 indicates the valve opening direction, which is the lifting direction of the needle 40 away from the valve seat 255, and the valve closing direction, which is the seating direction of the needle 40 against the valve seat 255.

The fuel injection valve 11 of the eleventh embodiment includes the flange receiving member 70. The flange receiving member 70 is reciprocatably placed on the opposite side of the movable core 50, which is opposite from the valve seat 255. The flange receiving member 70 includes the circular plate portion (serving as the contact member) 61 and a plurality of legs (serving as a plurality of leg members) 72. The circular plate portion 61 and the legs 72 are formed integrally as a one-piece body.

The legs 72 are formed to extend from an end surface of an outer periphery of the circular plate portion 61, which is located on the valve seat 255 side, toward the valve seal 255. In the eleventh embodiment, as shown in FIG. 18, the number of the legs 72 is six, and these six legs 72 are arranged one after another in the circumferential direction. An end surface 722 of each of the legs 72, which is located on the valve seat 255 side, is formed to be abuttable against the movable core second contact surface 502. A radially inner side inner wall 721 of each leg 72 has a cross section that is shaped into an arcuate form, and the radially inner side inner wall 721 of each leg 72 is slidable relative to the radially outer side outer wall 435 of the flange 43. A radially outer side outer wall 723 of each leg 72 is slidable relative to the inner wall of the stationary core slidable portion 302.

Each leg 72 has a length that enables reciprocation of the flange 43 in the inside of the flange receiving member 70. A gap 72*a*, which is formed between each circumferentially adjacent two of the legs 72, serves as a leg member communication passage that communicates between the gap 430 and the outside of the flange receiving member 70.

In the fuel injection valve 11 of the eleventh embodiment, in the state where the circular plate portion 61 of the flange receiving member 70, which receives the flange 43, abuts against the shaft portion 41 and the flange 43, and the multiple legs 72 of the flange receiving member 70 abut against the movable core 50, the gap 430 is formed between the flange member end surface 431 of the needle 40 and the movable core first contact surface 501 of the movable core 50 (see FIG. 17). Thus, the eleventh embodiment can achieve the advantages (a)-(d), (f)-(l) of the first embodiment.

In the present embodiment, the multiple legs 72 are described as the plurality of leg members. Alternatively, the multiple legs 72 may be considered as a leg member that is formed by forming the gaps (slits) 72*a* in a single cylindrical tubular leg member. This idea is similarly applicable to legs of each of the following embodiments.

(Twelfth Embodiment)

Figure 19:
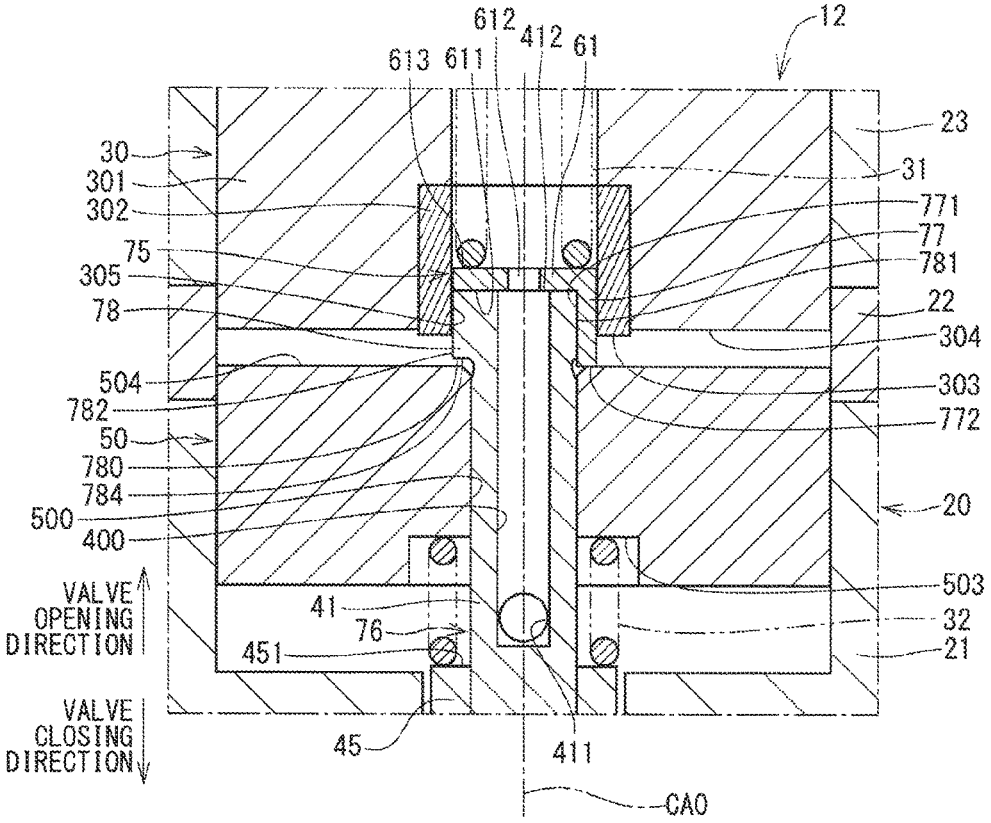
FIG. 19 is a cross sectional view of a fuel injection valve according to a twelfth embodiment of the present disclosure.

Next, a fuel injection valve according to a twelfth embodiment of the present disclosure will be described with reference to FIGS. 19 to 22. The twelfth embodiment differs from the first embodiment with respect to the shape the flange and the shape of the flange receiving member. Here, components, which are substantially the same as those of the first embodiment, will be indicated by the same reference signs and will not be described for the sake of simplicity. FIG. 19 indicates the valve opening direction, which is the lifting direction of the needle 76 away from the valve seat 255, and the valve closing direction, which is the seating direction of the needle 76 against the valve seat 255.

The fuel injection valve 12 of the twelfth embodiment includes the flange receiving member 75. The flange receiving member 75 is reciprocatably placed on the opposite side of the movable core 50, which is opposite from the valve seat 255. The flange receiving member 75 includes the circular plate portion (serving as the contact member) 61 and a plurality of legs (serving as a plurality of leg members) 77. The circular plate portion 61 and the legs 77 are formed integrally as a one-piece body.

Figure 20:
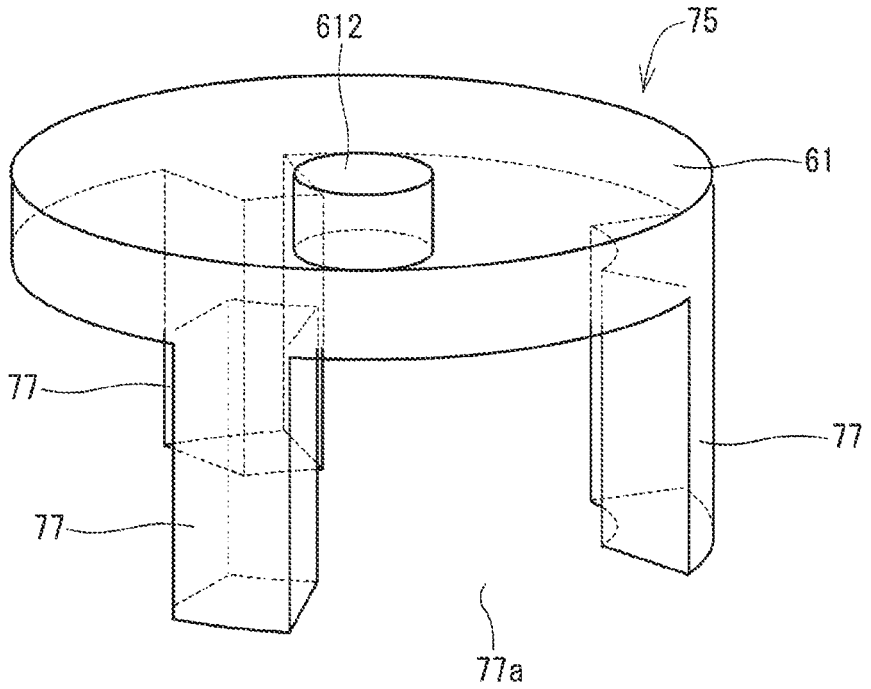
FIG. 20 is a perspective view of a flange receiving member of the fuel injection valve according to the twelfth embodiment of the present disclosure.

The legs 77 are formed to extend from an end surface of an outer periphery of the circular plate portion 61, which is located on the valve seat 255 side, toward the valve seat 255. As shown in FIG. 20, in the twelfth embodiment, the number of the legs 77 is three, and these three legs 77 are arranged one after another at equal intervals in the circumferential direction. An end surface 722 of each of the legs 77, which is located on the valve seat 255 side, is formed to be abuttable against the movable core fourth contact surface 504 of the movable core 50, which is opposite from the injection holes 26. A radially inner side inner wall 771 of each leg 77 has a cross section that is shaped into an arcuate form, The movable core fourth contact surface 504 serves as "a movable core contact surface" and "an end surface of the movable core, which is opposite from the valve seat."

The needle 76 is reciprocatably received in the inside of the housing 20. The needle 76 includes the shaft portion 41, the seal portion 42, and a flange (serving as a flange member) 78. The shaft portion 41, the seal portion 42 and the flange 78 are formed integrally as a one-piece body.

Figure 21:
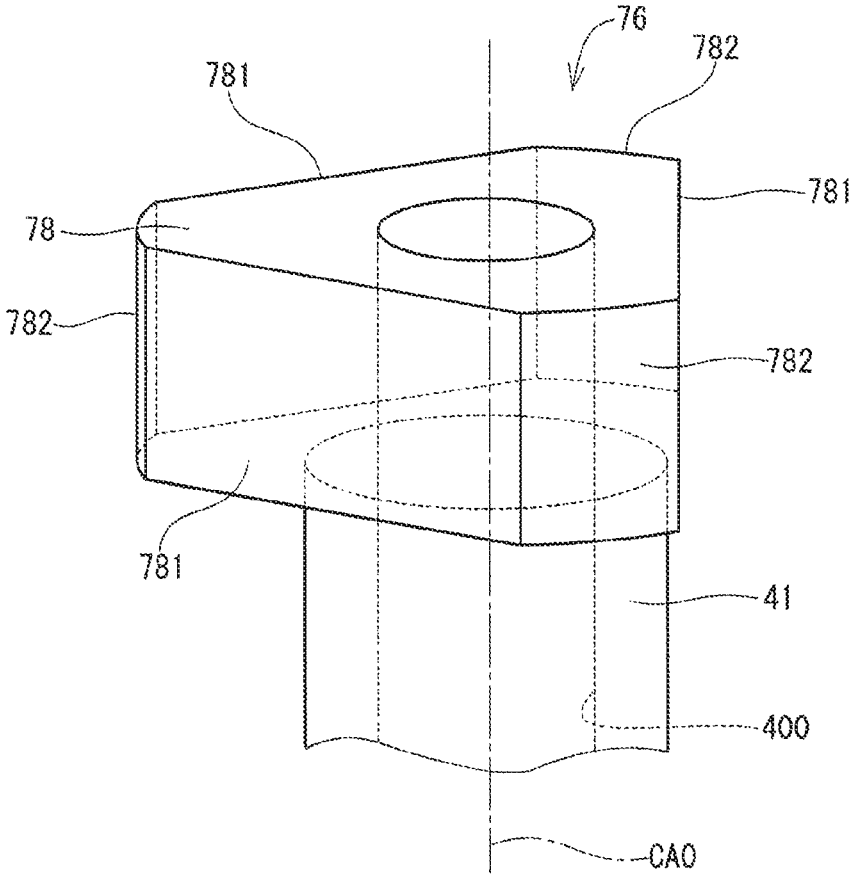
FIG. 21 is a perspective view of a needle of the fuel injection valve according to the twelfth embodiment of the present disclosure.

The flange 78 is formed on a radially outer side of the end part of the shaft portion 41, which is located on the stationary core 30 side. The flange 78 includes broken parts (serving as flange broken parts) 781, which are radially inwardly recessed from an outer peripheral edge of a circular ring. The broken parts 781 are recessed in parallel with the central axis CAO. In the twelfth embodiment, as shown in FIG. 21, the number of the broken parts 781 is three, and these three broken parts 781 are arranged one after another in the circumferential direction at equal intervals. Thereby, a cross section of the flange 78, which is perpendicular to the central axis CAO, is shaped into a generally hexagonal form that has a hole generally in a center thereof.

Figure 22A:
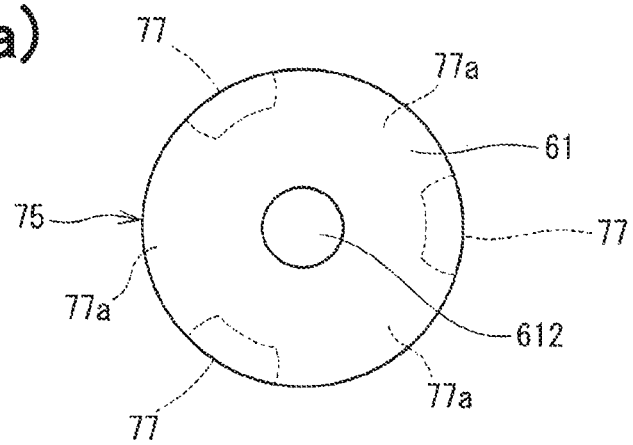
FIGS. 22(*a*) to 22(*c*) are top views of the flange receiving member and a flange of the fuel injection valve according to the twelfth embodiment of the present disclosure.
Figure 22B:
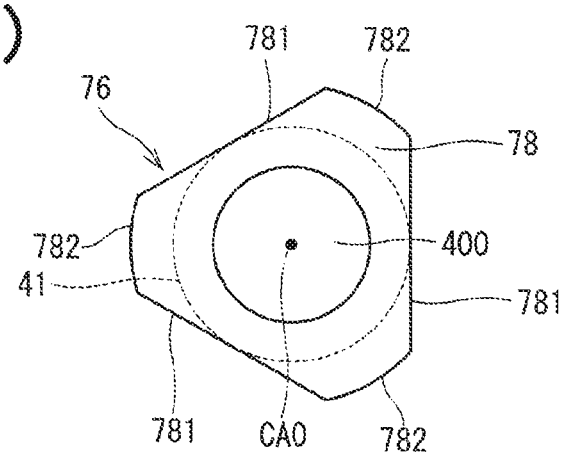
Figure 22C:
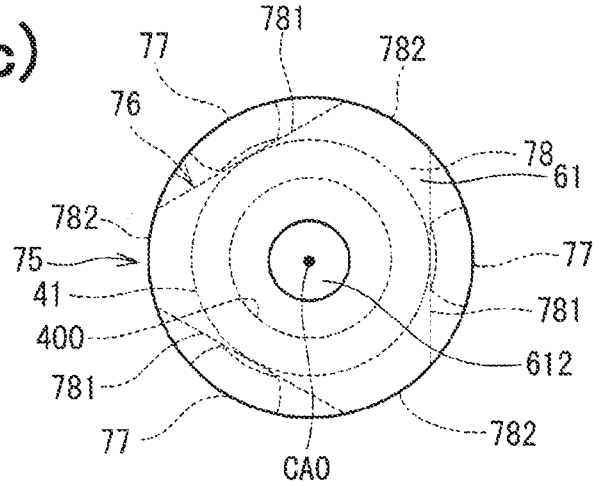

As shown in FIG. 22(*b*), the outer wall of each of the broken parts 781 is formed such that a cross section of the outer wall of the broken part 781, which is perpendicular to the central axis CAO, forms a straight line. The outer walls of the broken parts 781 are slid relative to the inner walls 771 of the legs 77, respectively. Radially outer side outer walls 782 of the flange 78, which are other than the broken parts 781, are slid relative to the inner wall 305 of the stationary core slidable portion 302. Each of the legs 77 of the flange receiving member 75 is placed between the outer wall of the corresponding one of the broken parts 781 and the inner wall 305 of the stationary core slidable portion 302 (see FIGS. 19 and 22(*c*)).

Each of the legs 77 of the flange receiving member 75 has a length that enables reciprocation of the flange 78 in the inside of the flange receiving member 75. A gap 77*a*, which is formed between each circumferentially adjacent two of the legs 77, serves as a leg member communication passage that communicates between a gap 780, which is formed between the flange member end surface 784 of the flange 78 located on the valve seat 255 side and the movable core fourth contact surface 504, and the outside of the flange receiving member 70.

In the fuel injection valve 12 of the twelfth embodiment, in the state where the circular plate portion 61 of the flange receiving member 75, which receives the flange 78, abuts against the shaft portion 41 and the flange 78, and the multiple legs 77 of the flange receiving member 75 abut against the movable core 50, the gap 780 is formed (see FIG. 19). Thus, the advantages (a)-(g), (i)-(l) of the first embodiment are achieved.

In the twelfth embodiment, the outer walls 782 of the flange 78 are slid relative to the inner wall 305 of the stationary core slidable portion 302. Thereby, in comparison to the case where the two slidable portions guide the reciprocation of the needle 40 like in the first embodiment, in which the flange 43 is slidable relative to the flange receiving member 60, and the flange receiving member 60 is slidable relative to the stationary core slidable portion 302, the reciprocation of the needle 76 is guided only through the single slidable portion between the flange 78 and the stationary core slidable portion 302. Thus, in comparison to the case where the two slidable portions are managed, the management of the clearance is eased. Therefore, the twelfth embodiment can provide an advantage (t) of that the number of processing steps of the flange 78 and the flange receiving member 75 is reduced. When the clearance is increased due to wearing at each of the two slidable portions, there is a possibility of increasing the tilt angle of the needle. However, in the twelfth embodiment, in which the single slidable portion is provided, the amount of increase in the clearance is relatively small. Thus, the twelfth embodiment can provide an advantage (u) of that the tilt angle of the needle 76 is reduced.

(Thirteenth Embodiment)

Figure 23:
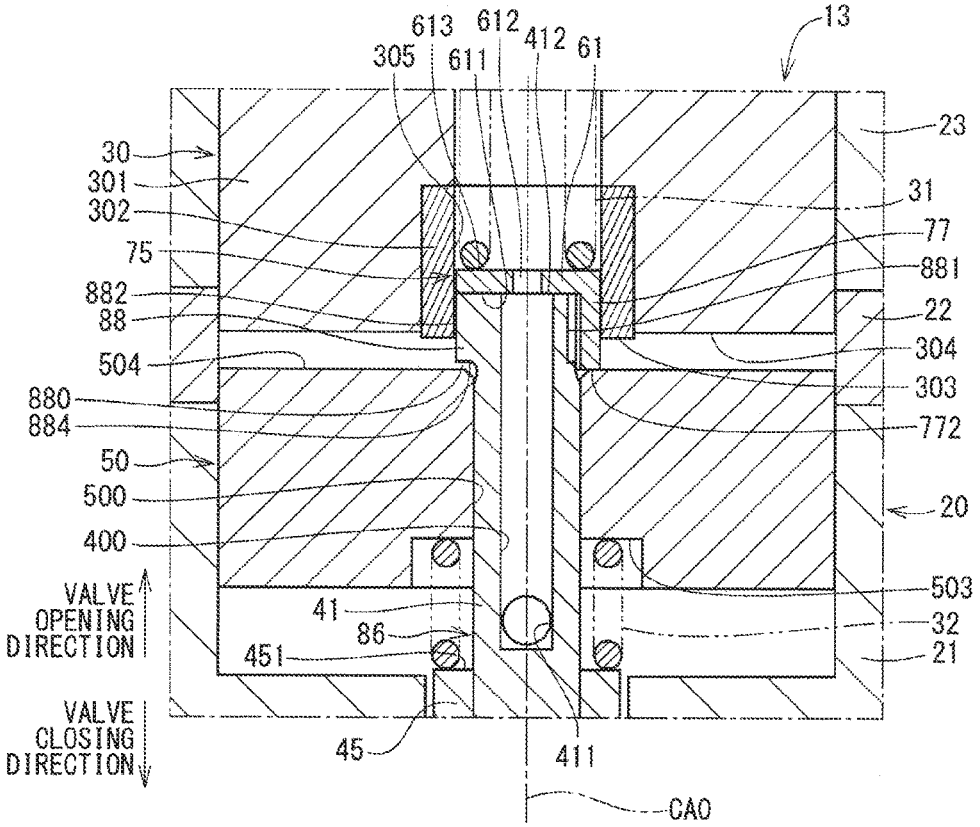
FIG. 23 is a cross sectional view of a fuel injection valve according to a thirteenth embodiment of the present disclosure.
Figure 24:
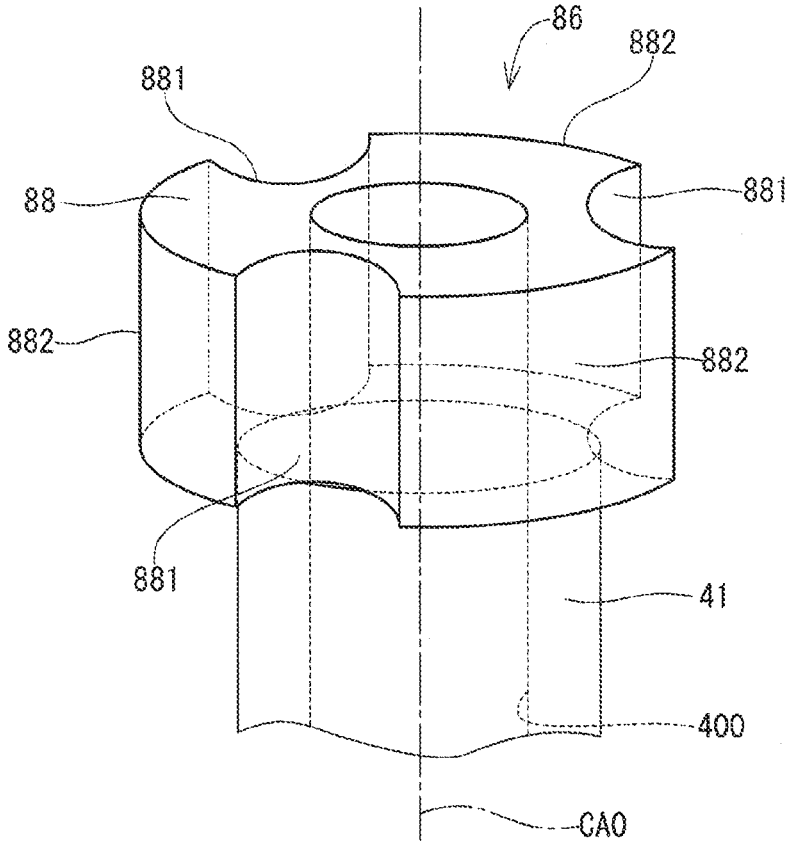
FIG. 24 is a perspective view of a needle of the fuel injection valve according to the thirteenth embodiment of the present disclosure.
Figure 25A:
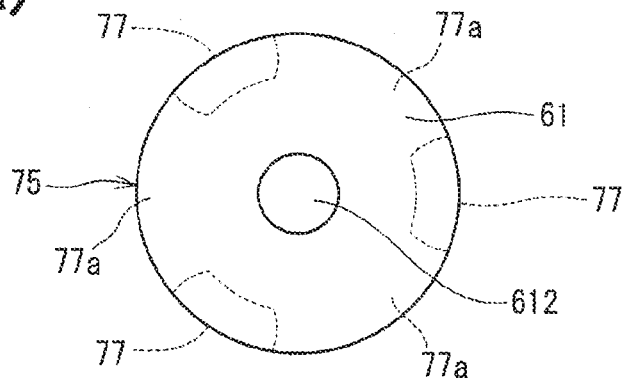
FIGS. 25(*a*) to 25(*c*) are top views of a flange receiving member and a flange of the fuel injection valve according to the thirteenth embodiment of the present disclosure.
Figure 25B:
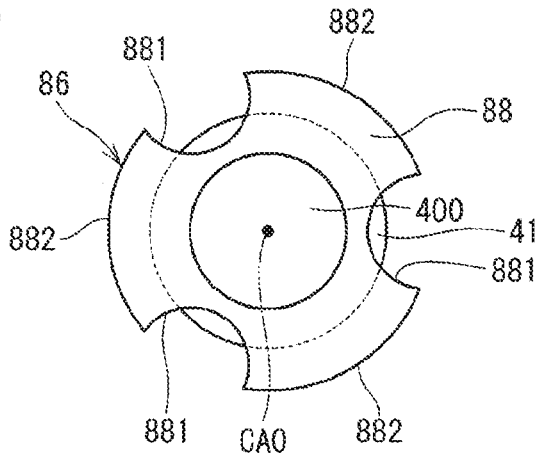
Figure 25C:
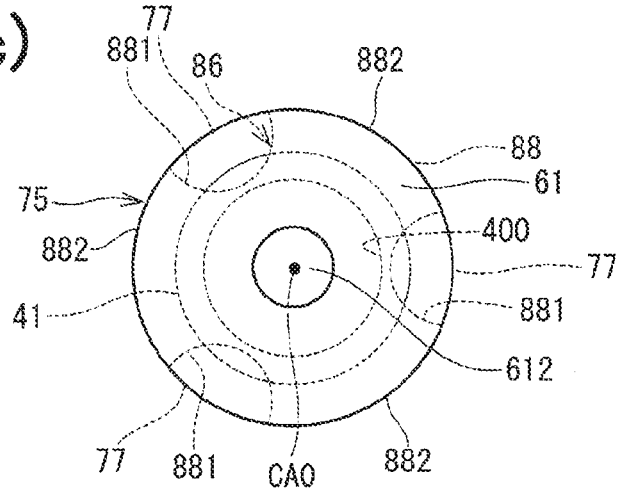

Next, a fuel injection valve according to a thirteenth embodiment of the present disclosure will be described with reference to FIGS. 23 to 25. The thirteenth embodiment differs from the twelfth embodiment with respect to the shape the flange. Here, components, which are substantially the same as those of the twelfth embodiment, will be indicated by the same reference signs and will not be described for the sake of simplicity. FIG. 23 indicates the valve opening direction, which is the lifting direction of the needle 86 away from the valve seat 255, and the valve closing direction, which is the seating direction of the needle 86 against the valve seat 255.

The fuel injection valve 13 of the thirteenth embodiment includes the needle 86. The needle 86 is reciprocatably received in the inside of the housing 20. The needle 86 includes the shaft portion 41, the seal portion 42, and a flange (serving as a flange member) 88. The shaft portion 41, the seal portion 42 and the flange 88 are formed integrally as a one-piece body.

The flange 88 is formed on a radially outer side of the end part of the shaft portion 41, which is located on the stationary core 30 side. The flange 78 includes three broken parts (serving as flange broken parts) 881, which are arranged one after another at equal intervals in the circumferential direction and are radially inwardly recessed from the outer peripheral edge of the circular ring. As shown in FIG. 24, a cross section of an outer wall of each broken part 881, which is perpendicular to the central axis CAO, is arcuate. Outer walls of the broken parts 881 are slid relative to the inner walls of the legs 77, respectively (see FIG. 25(*c*)). Radially outer side outer walls 882 of the flange 88, which are other than the broken parts 881, are slid relative to the inner wall 305 of the stationary core slidable portion 302. Each of the legs 77 of the flange receiving member 75 is placed between the outer wall of the corresponding one of the broken parts 881 and the inner wall 305 of the stationary core slidable portion 302 (see FIGS. 23 and 25(*c*)).

Each of the legs 77 of the flange receiving member 75 has the length that enables reciprocation of the flange 88 in the inside of the flange receiving member 75. A gap 77*a*, which is formed between each circumferentially adjacent two of the legs 77, serves as a leg member communication passage that communicates between a gap 880, which is formed between a flange member end surface 884 of the flange 88 located on the valve seat 255 side and the movable core fourth contact surface 504, and the outside of the flange receiving member 75.

In the thirteenth embodiment, the outer walls 882 of the flange 88 are slid relative to the inner wall 305 of the stationary core slidable portion 302. A cross section of each of the outer walls 882 of the flange 88 is arcuate, so that a slidable surface area of the outer wall 882, which is slidable relative to the inner wall 305 of the stationary core slidable portion 302, is larger than that of the outer wall 782 of the flange 78 of the twelfth embodiment. Thus, the thirteenth embodiment can achieve the advantages of the twelfth embodiment and can achieve another advantage of that the reciprocation of the needle 86 is further stably guided.

(Fourteenth Embodiment)

Figure 26:
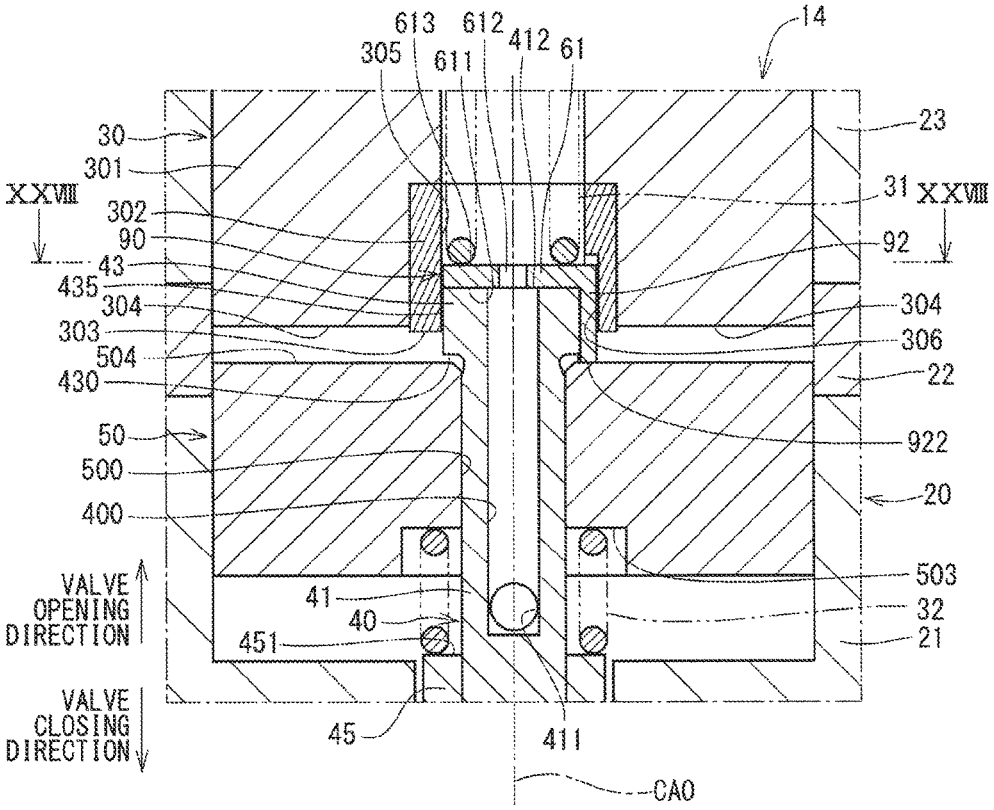
FIG. 26 is a cross sectional view of a fuel injection valve according to a fourteenth embodiment of the present disclosure.
Figure 27:
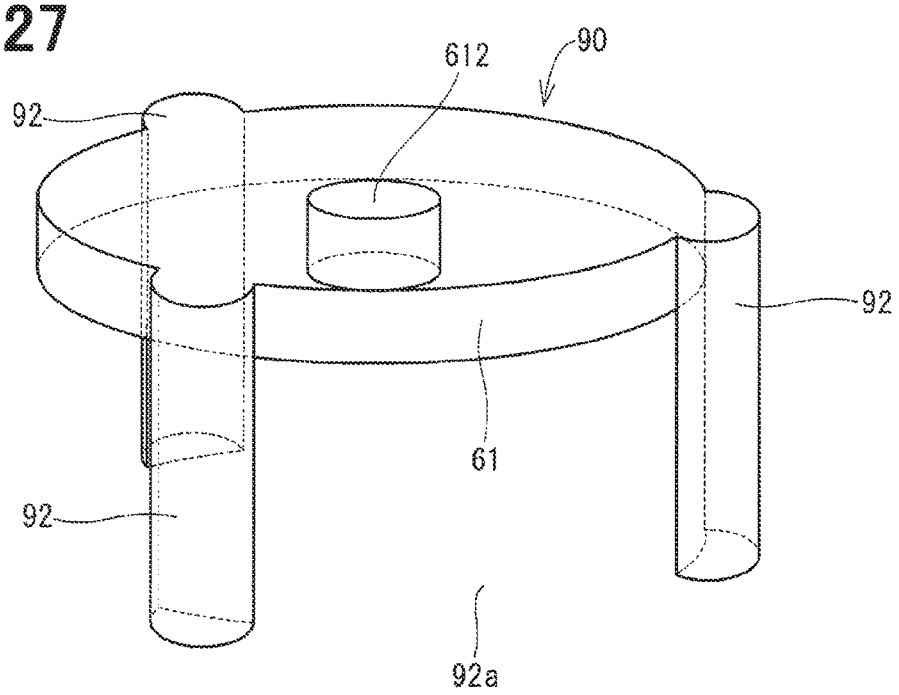
FIG. 27 is a perspective view of a flange receiving member of the fuel injection valve according to the fourteenth embodiment of the present disclosure.

Next, a fuel injection valve according to a fourteenth embodiment of the present disclosure will be described with reference to FIGS. 26 to 28. The fourteenth embodiment differs from the first embodiment with respect to the shape the core slidable portion and the shape of the flange receiving member. Here, components, which are substantially the same as those of the first embodiment, will be indicated by the same reference signs and will not be described for the sake of simplicity. FIG. 26 indicates the valve opening direction, which is the lifting direction of the needle 40 away from the valve seat 255, and the valve closing direction, which is the seating direction of the needle 40 against the valve seat 255.

The fuel injection valve 14 of the fourteenth embodiment includes the flange receiving member 90. The flange receiving member 90 is reciprocatably placed on the opposite side of the movable core 50, which is opposite from the valve seat 255. The flange receiving member 90 includes the circular plate portion (serving as the contact member) 61 and a plurality of legs (serving as a plurality of leg members) 92. The circular plate portion 61 and the legs 92 are formed integrally as a one-piece body.

The legs 92 extend from the circular plate portion 61 toward the valve seat 255. As shown in FIG. 27, the legs 92 are formed as a plurality of legs formed on the radially outer side of the circular plate portion 61. In the fourteenth embodiment, the number of the legs 92 is three, and these three legs 92 are arranged one after another at equal intervals in the circumferential direction. A gap (serving as a leg member communication passage) 92*a* is formed between each circumferentially adjacent two of the legs 92. A radially inner side inner wall of each leg 92 has a cross section that is perpendicular to the central axis CAO and is shaped into an arcuate form, and the radially inner side inner wall of each leg 92 is slidable relative to the radially outer side outer wall of the flange 43. An end surface 922 of each of the legs 92, which is located on the valve seat 255 side, is formed to be abuttable against the movable core fourth contact surface 504. The legs 92 are received in broken parts (serving as core broken parts) 306, respectively, of the stationary core slidable portion 302.

The stationary core slidable portion 302 includes the multiple broken parts 306 at an end part of the stationary core slidable portion 302, which is located on the valve seat 255 side. As shown in FIG. 28, which shows the stationary core slidable portion 302 and the flange receiving member 90 viewed in the direction of the central axis CAO, each broken part 306 is radially outwardly recessed from the inner wall of the stationary core slidable portion 302.

In the fuel injection valve 14 of the fourteenth embodiment, in the state where the circular plate portion 61 of the flange receiving member 90, which receives the flange 43, abuts against the shaft portion 41 and the flange 43, and the multiple legs 92 of the flange receiving member 90 abut against the movable core 50, the gap 430 is formed (see FIG. 26). Thus, the advantages (a)-(c), (g), (i)-(l) of the first embodiment are achieved.

Figure 28:
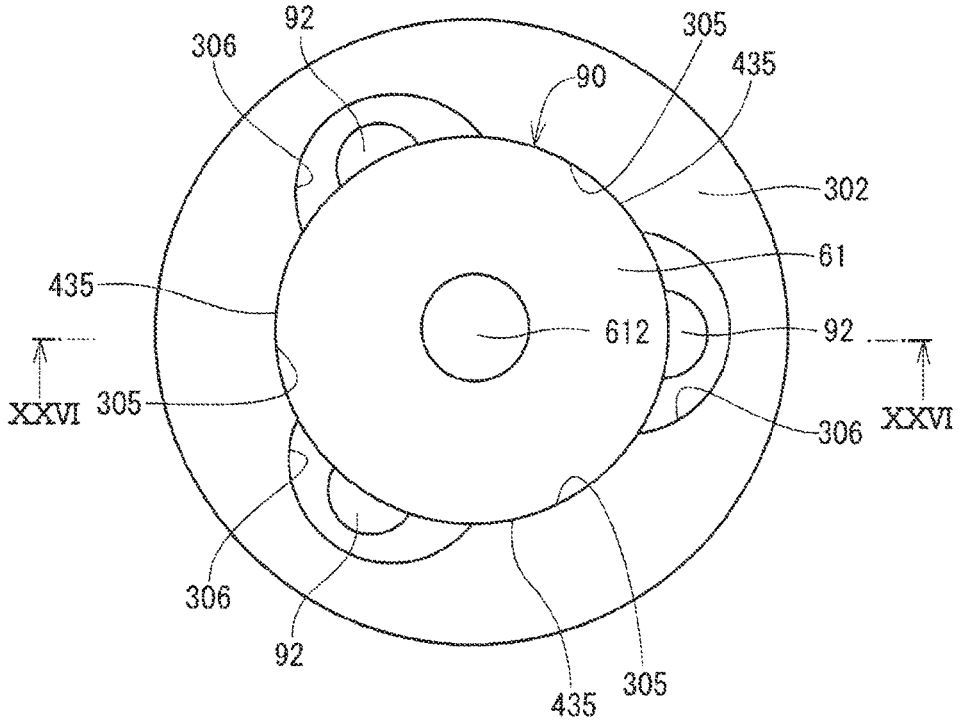
FIG. 28 is a cross sectional view taken along line XXVIII-XXVIII in FIG. 26.

Furthermore, in the fourteenth embodiment, as shown in FIGS. 26 and 28, the outer wall 435 of the flange 43 is slidable relative to portions of the inner wall 305, in which the broken parts 306 of the stationary core slidable portion 302 are not formed. Thereby, in comparison to the case where the two slidable portions guide the reciprocation of the needle 40 like in the first embodiment, in which the flange 43 is slidable relative to the flange receiving member 60, and the flange receiving member 60 is slidable relative to the stationary core slidable portion 302, the reciprocation of the needle 40 is guided only through the single slidable portion between the flange 43 and the stationary core slidable portion 302. Thus, the fourteenth embodiment can achieve the advantages (t), (u) of the twelfth embodiment.

(Fifteenth Embodiment)

Figure 29:
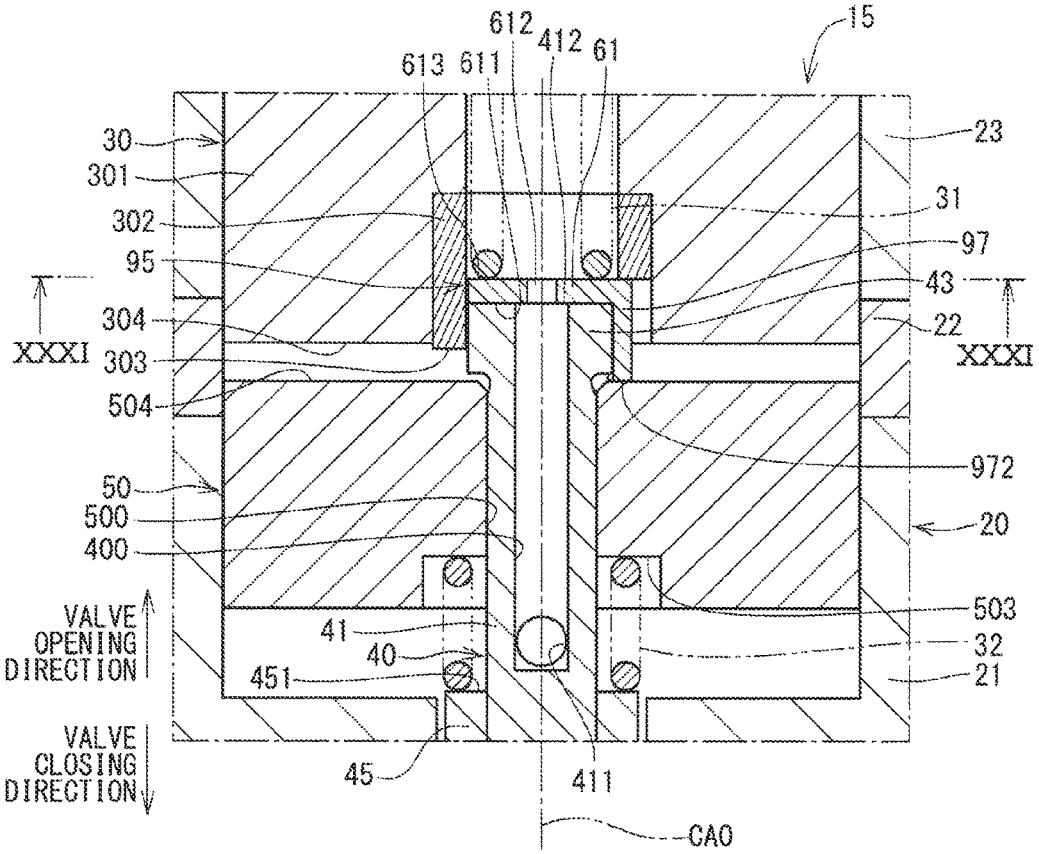
FIG. 29 is a cross sectional view of a fuel injection valve according to a fifteenth embodiment of the present disclosure.
Figure 30:
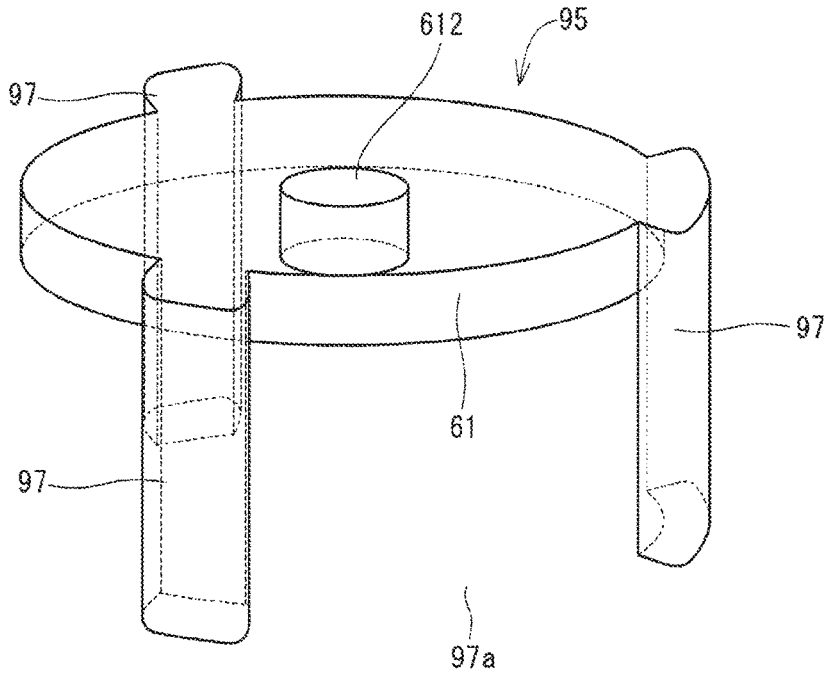
FIG. 30 is a perspective view of a flange receiving member of the fuel injection valve according to the fifteenth embodiment of the present disclosure.

Next, a fuel injection valve according to a fifteenth embodiment of the present disclosure will be described with reference to FIGS. 29 to 31. The fifteenth embodiment differs from the first embodiment with respect to the shape the core slidable portion and the shape of the flange receiving member. Here, components, which are substantially the same as those of the first embodiment, will be indicated by the same reference signs and will not be described for the sake of simplicity. FIG. 29 indicates the valve opening direction, which is the lifting direction of the needle 40 away from the valve seat 255, and the valve closing direction, which is the seating direction of the needle 40 against the valve seat 255.

The fuel injection valve 15 of the fifteenth embodiment includes the flange receiving member 95. The flange receiving member 95 is reciprocatably placed on the opposite side of the movable core 50, which is opposite from the valve seat 255. The flange receiving member 95 includes the circular plate portion (serving as the contact member) 61 and a plurality of legs (serving as a plurality of leg members) 97. The circular plate portion 61 and the legs 97 are formed integrally as a one-piece body.

The legs 97 extend from the circular plate portion 61 toward the valve seat 255. As shown in FIG. 30, the legs 97 are formed as a plurality of legs formed on the radially outer side of the outer peripheral edge of the circular plate portion 61. In the fifteenth embodiment, the number of the legs 97 is three, and these three legs 97 are arranged one after another at equal intervals in the circumferential direction at the circular plate portion 61. A gap (serving as a leg member communication passage) 97*a* is formed between each circumferentially adjacent two of the legs 97. The amount of projection of each leg 97 toward the radially outer side of the circular plate portion 61 is larger than that of the leg 92 of the fourteenth embodiment, and a cross sectional area of the leg 97 taken in the direction perpendicular to the central axis CAO is larger than that of the leg 92.

A radially inner side inner wall of each leg 92 has a cross section that is perpendicular to the central axis CAO and is shaped into an arcuate form, and the radially inner side inner wall of each leg 92 is slidable relative to the radially outer side outer wall of the flange 43. An end surface 972 of each of the legs 97, which is located on the valve seat 255 side, is formed to be abuttable against the movable core fourth contact surface 504. The legs 97 are received in broken parts (serving as core broken parts) 307, respectively, of the stationary core slidable portion 302.

Figure 31:
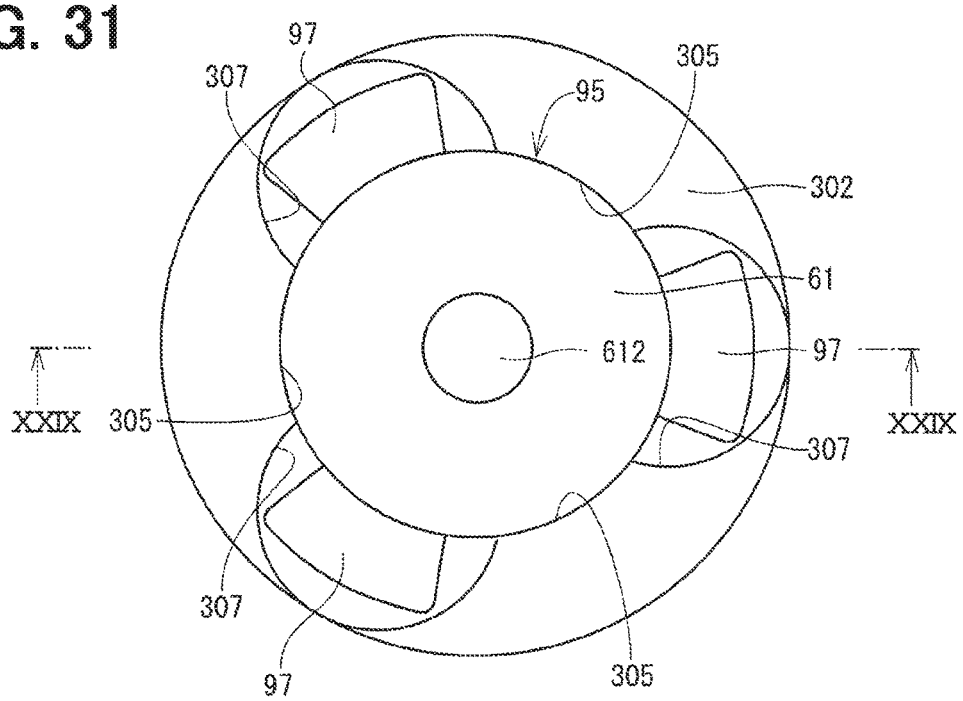
FIG. 31 is a cross sectional view taken along line XXXI-XXXI in FIG. 30.

An end part of the stationary core slidable portion 302, which is located on the valve seat 255 side, includes the multiple broken parts 307 (see FIG. 31). As shown in FIG. 31, which shows the stationary core slidable portion 302 and the flange receiving member 95 viewed in the direction of the central axis CAO, each broken part 307 is radially outwardly recessed from the inner wall of the stationary core slidable portion 302. Each broken part 307 is more largely recessed in comparison to the broken parts 306 of the fourteenth embodiment and thereby has a space that can receive the leg 97, which is larger than the leg 92 of the fourteenth embodiment.

The flange receiving member 95 of the fifteenth embodiment includes the legs 97, which are larger than the legs 92 of the flange receiving member 90 of the fourteenth embodiment. Thus, the fifteenth embodiment can achieve the advantages of the fourteenth embodiment and can increase the rigidity of the flange receiving member 95.

(Other Embodiments)

(1) In the first embodiment, and the third to the eighth embodiments, the flange receiving member includes the contact member and the leg member(s). However, the configuration of the portion, which forms the flange receiving member, is not limited to this configuration.

(2) In the above embodiments, the gap, which is defined by the flange member end surface and the movable core first contact surface or the movable core fourth contact surface, is communicatable with the flow passage through the needle communication passage formed in the shaft portion. However, the communication passage, which communicates between the gap and the flow passage, may be formed in the flange member.

(3) In the first to sixth embodiments and the eighth to fifteenth embodiments, the cross sectional area of the communication passage of the contact member is smaller than the cross sectional area of the flow passage of the shaft portion. However, the relationship between the cross sectional area of the communication passage and the cross sectional area of the flow passage should not be limited to this relationship.

(4) In the first to fifth embodiments and the ninth to fifteenth embodiments, the movable core slidable portion of the sixth or seventh embodiment may be provided.

(5) In the fifth to tenth embodiments, the circular plate portion and the tubular portion of the flange receiving member are formed integrally as the one-piece body. However, the circular plate portion and the tubular portion of the flange receiving member may be formed separately as separate members, respectively.

(6) In the first to fourth embodiments, and the sixth to fifteenth embodiments, the stationary core includes the stationary core slidable portion that is slidable relative to the flange receiving member or the flange. However, the stationary core slidable portion may be eliminated like in the case of the fifth embodiment.

(7) In the third embodiment, the flange receiving member includes the two leg members, each of which has the cross section that is shaped into the arcuate form. Furthermore, in the fourth embodiment, the flange receiving member includes the four leg members, each of which has the cross section that is shaped into the circular form. However, the number of the leg members and shape of the cross section of the respective leg members should not be limited to the above-described ones. In the case where the multiple leg members are provided, although it is desirable that the leg members are arranged one after another at equal intervals in the circumferential direction, the locations of the leg members should not be limited to these locations.

(8) In the eleventh embodiment, the flange receiving member includes the six legs, which are arranged one after another at equal intervals. In the twelfth to fifteenth embodiments, the flange receiving member includes the three legs that are arranged one after another at equal intervals in the circumferential direction. However, the number of the legs and the locations of the legs should not be limited to the above-described ones. It is only required that at least one leg is provided.

(9) In the twelfth and thirteenth embodiments, the outer walls of the flange broken parts are slid relative to the inner walls of the legs, respectively. However, the outer walls of the flange broken parts may not be slid relative to the inner walls of the legs, respectively.

(10) In the eleventh to thirteenth embodiments, the flange includes the multiple flange broken parts, the number of which is equal to the number of the legs of the flange receiving member. However, the number of the legs and the number of the flange broken parts may not be equal to each other. In the fourteenth and fifteenth embodiments, the stationary core includes the multiple core broken parts, the number of which is equal to the number of the legs of the flange receiving member. However, the number of the legs and the number of the core broken parts may not be equal to each other.

(11) In the thirteenth embodiment, the cross section of the outer wall of each flange broken part, which is perpendicular to the central axis, is arcuate. However, the cross section of the outer wall of each flange broken part, which is perpendicular to the central axis, may be a curved line form.

(12) In the first embodiment, the fifth to eleventh embodiments, and the fourteenth to fifteenth embodiments, the leg(s) is slidable relative to the flange. Furthermore, in the first embodiment and the fifth to eleventh embodiments, the leg(s) is slidable relative to the stationary core. However, the leg(s) may not be slid relative to the flange and the stationary core.

(13) The leg member communication passage(s) may not be the hole of the first embodiment or the multiple gaps of the eleventh embodiment. The leg member communication passage(s) may be a cutout, which is formed in the end part of the leg member located on the movable core side, or a groove, which is formed in the end surface of the leg member located on the movable core side.

(14) In the first to twelfth embodiments, the needle communication passage, which communicates between the gap and the flow passage, is formed. The needle communication passage may be eliminated.

(15) In the second to seventh embodiments and the ninth to fifteenth embodiments, the third urging member may be provided. In the second to ninth embodiments and the eleventh to fifteenth embodiments, the limiting member may be provided.

The present disclosure should not be limited to the above embodiments and may be implemented in various forms without departing form the principle of the present disclosure. The constituent components of the above embodiments may be freely combined within the scope of the present disclosure. For example, at least one of the needle member, the flange member, the stationary core, the movable core, the contact member and the leg member of the fuel injection valve of any one of the above embodiments may be used in place of the corresponding constituent component(s) of the fuel injection valve of another one of the above embodiments.

The invention claimed is:

1. A fuel injection valve comprising:

a housing that is shaped into a tubular form and includes:
- an injection hole that is formed at one end part of the housing in a direction of a central axis of the housing, wherein the injection hole injects fuel;
- a valve seat that is formed around the injection hole; and
- a fuel passage that conducts fuel to the injection hole;

a needle member that is received in the housing such that the needle member is reciprocatable in the direction of the central axis of the housing, wherein the needle member opens or closes the injection hole when one end part of the needle member is lifted away from the valve seat or is seated against the valve seat;

a flange member that radially outwardly projects from a section of another end part of the needle member;

a stationary core that is fixed in an inside of the housing;

a movable core that is movable relative to the needle member on a side of the flange member where the valve seat is placed, wherein the movable core includes a movable core contact surface that is abuttable against a flange member end surface of the flange member located on the side where the valve seat is placed;

a coil that attracts the movable core toward the stationary core when an electric power is supplied to the coil;

a contact member that is abuttable against at least one of:
- an end surface of the needle member located on a side, which is opposite from the valve seat; and
- an end surface of the flange member located on the side, which is opposite from the valve seat;

a leg member that has one end part, which is formed integrally with the contact member or is abuttable against the contact member, and another end part, which extends away from the contact member toward the valve seat and is abuttable against an end surface of the movable core, which is opposite from the valve seat, wherein a gap is formed between the flange member end surface and the movable core contact surface in a state where the another end part of the leg member abuts against the movable core, and the contact member abuts against the flange member or the needle member; and a first urging member that has one end part, which contacts the contact member and urges the needle member toward the valve seat, wherein:

the fuel injection valve includes the leg member as at least one leg member;

the flange member has an outer diameter larger than an outer diameter of the needle member and has at least one flange broken part, which is radially inwardly recessed from an outer peripheral edge of the flange member, and an outer wall of the flange member is slidable relative to an inner wall of the stationary core; and the at least one leg member is located between the at least one flange broken part and the stationary core.

2. The fuel injection valve according to claim 1, wherein the contact member and the leg member are formed integrally as a one-piece body.

3. The fuel injection valve according to claim 1, wherein the contact member and the leg member are formed separately from each other.

4. The fuel injection valve according to claim 1, wherein a number of the at least one flange broken part of the flange member is equal to a number of the at least one leg member.

5. The fuel injection valve according to claim 1, wherein a cross section of an outer wall of the at least one flange broken part of the flange member, which is perpendicular to the central axis, is shaped into a curved line form or an arcuate from.

6. The fuel injection valve according to claim 1, wherein:

the stationary core includes at least one core broken part that is radially outwardly recessed from an inner wall of the stationary core; and the at least one leg member is located between the at least one core broken part and the flange member.

7. The fuel injection valve according to claim 6, wherein a number of the at least one core broken part of the stationary core is equal to a number of the at least one leg member.

8. The fuel injection valve according to claim 1, wherein the leg member is shaped into a tubular form.

9. The fuel injection valve according to claim 1, wherein the leg member is slidable relative to the flange member.

10. The fuel injection valve according to claim 1, wherein the leg member is slidable relative to the stationary core.

11. The fuel injection valve according to claim 1, wherein:

the flange member includes a flange member insertion hole that communicates between a wall surface of the flange member, which is located on a side where the movable core is placed, and a wall surface of the flange member, which is located on a side where the contact member is placed; and the leg member is received through the flange member insertion hole.

12. The fuel injection valve according to claim 1, wherein the leg member has a leg member communication passage, through which a side of the leg member opposite from the gap is communicatable with the gap.

13. The fuel injection valve according to claim 1, wherein the needle member includes a flow passage, in which the fuel of the fuel passage flows.

14. The fuel injection valve according to claim 13, wherein the needle member or the flange member includes a needle communication passage, through which the gap is communicatable with the flow passage.

15. The fuel injection valve according to claim 13, wherein:

the contact member includes a contact member communication passage, through which the fuel passage is communicatable with the flow passage; and a cross-sectional area of the contact member communication passage is smaller than a cross-sectional area of the flow passage.

16. The fuel injection valve according to claim 1, wherein:

the contact member includes a contact member insertion hole, through which the another end part of the needle member is inserted; and the another end part of the needle member projects from the contact member insertion hole in a direction opposite from the valve seat, and an outer wall of the another end part of the needle member guides an expansion and contraction movement of the first urging member.

17. The fuel injection valve according to claim 1, wherein the movable core includes a movable core slidable portion that is made of a material, which has a degree of hardness being generally equal to a degree of hardness of the needle member, and an inner wall of the movable core slidable portion is slidable relative to an outer wall of the needle member.

18. The fuel injection valve according to claim 17, wherein the movable core slidable portion is made of the material, which has the degree of hardness being generally equal to a degree of hardness of the flange member and a degree of hardness of the leg member, and the movable core slidable portion is abuttable against the flange member and the leg member.

19. The fuel injection valve according to claim 1, wherein the stationary core includes a stationary core slidable portion that is made of a material, which has a degree of hardness being generally equal to a degree of hardness of the contact member, a degree of hardness of the leg member, or a degree of hardness of the flange member, and an inner wall of the stationary core slidable portion is slidable relative to the contact member, the leg member, or the flange member.

20. The fuel injection valve according to claim 19, wherein the stationary core slidable portion is abuttable against the movable core.

21. The fuel injection valve according to claim 1, comprising a second urging member that has one end part, which contacts a side of the movable core located on the side where the valve seat is placed, and another end part, which contacts a spring seat fixed to a radially outer side of the needle member or contacts an inner wall of the housing, wherein the second urging member urges the movable core toward the stationary core.

22. The fuel injection valve according to claim 1, comprising a third urging member that has one end part, which contacts the movable core, and another end part, which contacts an inner wall of the housing, wherein the third urging member urges the movable core toward the stationary core.

23. The fuel injection valve according to claim 1, comprising a limiting member, which limits movement of the movable core toward the valve seat.

24. A fuel injection valve comprising:

a housing that is shaped into a tubular form and includes:

an injection hole that is formed at one end part of the housing in a direction of a central axis of the housing, wherein the injection hole injects fuel;

a valve seat that is formed around the injection hole; and a fuel passage that conducts fuel to the injection hole;

a needle member that is received in the housing such that the needle member is reciprocatable in the direction of the central axis of the housing, wherein the needle member opens or closes the injection hole when one end part of the needle member is lifted away from the valve seat or is seated against the valve seat;

a flange member that radially outwardly projects from a section of another end part of the needle member;

a stationary core that is fixed in an inside of the housing;

a movable core that is movable relative to the needle member on a side of the flange member where the valve seat is placed, wherein the movable core includes a movable core contact surface that is abuttable against a flange member end surface of the flange member located on the side where the valve seat is placed;

a coil that attracts the movable core toward the stationary core when an electric power is supplied to the coil;

a contact member that is abuttable against at least one of:

an end surface of the needle member located on a side, which is opposite from the valve seat; and an end surface of the flange member located on the side, which is opposite from the valve seat;

a leg member that has one end part, which is formed integrally with the contact member or is abuttable against the contact member, and another end part, which extends away from the contact member toward the valve seat and is abuttable against an end surface of the movable core, which is opposite from the valve seat, wherein a gap is formed between the flange member end surface and the movable core contact surface in a state where the another end part of the leg member abuts against the movable core, and the contact member abuts against the flange member or the needle member; and a first urging member that has one end part, which contacts the contact member and urges the needle member toward the valve seat, wherein the leg member has a leg member communication passage, through which a side of the leg member opposite from the gap is communicatable with the gap.

25. The fuel injection valve according to claim 24, wherein the contact member and the leg member are formed integrally as a one-piece body.

26. The fuel injection valve according to claim 24, wherein the contact member and the leg member are formed separately from each other.

27. The fuel injection valve according to claim 24, wherein:

the fuel injection valve includes the leg member as at least one leg member;

the flange member has an outer diameter larger than an outer diameter of the needle member, and an outer wall of the flange member is slidable relative to an inner wall of the stationary core;

the stationary core includes at least one core broken part that is radially outwardly recessed from an inner wall of the stationary core; and the at least one leg member is located between the at least one core broken part and the flange member.

28. The fuel injection valve according to claim 27, wherein a number of the at least one core broken part of the stationary core is equal to a number of the at least one leg member.

29. The fuel injection valve according to claim 24, wherein the leg member is shaped into a tubular form.

30. The fuel injection valve according to claim 24, wherein the leg member is slidable relative to the flange member.

31. The fuel injection valve according to claim 24, wherein the leg member is slidable relative to the stationary core.

32. The fuel injection valve according to claim 24, wherein:

the flange member includes a flange member insertion hole that communicates between a wall surface of the flange member, which is located on a side where the movable core is placed, and a wall surface of the flange member, which is located on a side where the contact member is placed; and the leg member is received through the flange member insertion hole.

33. The fuel injection valve according to claim 24, wherein the needle member includes a flow passage, in which the fuel of the fuel passage flows.

34. The fuel injection valve according to claim 33, wherein the needle member or the flange member includes a needle communication passage, through which the gap is communicatable with the flow passage.

35. The fuel injection valve according to claim 33, wherein:

the contact member includes a contact member communication passage, through which the fuel passage is communicatable with the flow passage; and a cross-sectional area of the contact member communication passage is smaller than a cross-sectional area of the flow passage.

36. The fuel injection valve according to claim 24, wherein:

the contact member includes a contact member insertion hole, through which the another end part of the needle member is inserted; and the another end part of the needle member projects from the contact member insertion hole in a direction opposite from the valve seat, and an outer wall of the another end part of the needle member guides an expansion and contraction movement of the first urging member.

37. The fuel injection valve according to claim 24, wherein the movable core includes a movable core slidable portion that is made of a material, which has a degree of hardness being generally equal to a degree of hardness of the needle member, and an inner wall of the movable core slidable portion is slidable relative to an outer wall of the needle member.

38. The fuel injection valve according to claim 37, wherein the movable core slidable portion is made of the material, which has the degree of hardness being generally equal to a degree of hardness of the flange member and a degree of hardness of the leg member, and the movable core slidable portion is abuttable against the flange member and the leg member.

39. The fuel injection valve according to claim 24, wherein the stationary core includes a stationary core slidable portion that is made of a material, which has a degree of hardness being generally equal to a degree of hardness of the contact member, a degree of hardness of the leg member, or a degree of hardness of the flange member, and an inner wall of the stationary core slidable portion is slidable relative to the contact member, the leg member, or the flange member.

40. The fuel injection valve according to claim 39, wherein the stationary core slidable portion is abuttable against the movable core.

41. The fuel injection valve according to claim 24, comprising a second urging member that has one end part, which contacts a side of the movable core located on the side where the valve seat is placed, and another end part, which contacts a spring seat fixed to a radially outer side of the needle member or contacts an inner wall of the housing, wherein the second urging member urges the movable core toward the stationary core.

42. The fuel injection valve according to claim 24, comprising a third urging member that has one end part, which contacts the movable core, and another end part, which contacts an inner wall of the housing, wherein the third urging member urges the movable core toward the stationary core.

43. The fuel injection valve according to claim 24, comprising a limiting member, which limits movement of the movable core toward the valve seat.

* * * * *